US007166969B2

(12) United States Patent
Kohno

(10) Patent No.: US 7,166,969 B2
(45) Date of Patent: Jan. 23, 2007

(54) DRIVE CIRCUIT FOR ILLUMINATION UNIT

(76) Inventor: Kazuo Kohno, 332-30 Shitengi, Ohami Shirasato-machi, Sanbu-gun, Chiba-pref. (JP)

( * ) Notice: Subject to any disclaimer, the term of this patent is extended or adjusted under 35 U.S.C. 154(b) by 0 days.

(21) Appl. No.: 10/968,041

(22) Filed: Oct. 20, 2004

(65) Prior Publication Data

US 2005/0099143 A1 May 12, 2005

(30) Foreign Application Priority Data

Nov. 10, 2003 (JP) ..... 2003-379369
Jun. 21, 2004 (JP) ..... 2004-182576
Jul. 6, 2004 (JP) ..... 2004-199070

(51) Int. Cl.
*F02P 3/12* (2006.01)
*H05B 37/02* (2006.01)
*H05B 39/04* (2006.01)
*H05B 41/00* (2006.01)
*H05B 41/36* (2006.01)

(52) U.S. Cl. ..... 315/209 PZ; 315/209 T; 315/220

(58) Field of Classification Search ..... 315/177, 315/178, 179, 209 T, 209 PZ, DIG. 5
See application file for complete search history.

(56) References Cited

U.S. PATENT DOCUMENTS 4,413,209 A * 11/1983 Roche ..... 315/101
4,441,055 A * 4/1984 Balchjunas et al. ..... 315/288
4,682,082 A * 7/1987 MacAskill et al. ..... 315/219
5,406,174 A * 4/1995 Slegers ..... 315/219
5,822,201 A * 10/1998 Kijima ..... 363/25
6,459,216 B1 * 10/2002 Tsai ..... 315/294
6,566,821 B1 * 5/2003 Nakatsuka et al. ... 315/209 PZ
2002/0070914 A1 * 6/2002 Bruning et al. ..... 345/102

* cited by examiner

*Primary Examiner*—Don Wong
*Assistant Examiner*—Marie Antoinette Cabucos
(74) *Attorney, Agent, or Firm*—Wenderoth, Lind & Ponack, L.L.P.

(57) ABSTRACT

In case of driving a plurality of lamps with the use of a plurality of output transformers, a difference in the brightness of each lamp occurs by a dispersion of characteristics of the output transformers, and an object is to prevent such troubles. For this purpose, a primary side of a plurality of output transformers of a one input-plural output type are respectively connected, and illumination units are connected to the secondary side of each output transformer. All of the secondary output terminals of each output transformer are connected to the secondary output terminals of counter phase and are connected by forming a loop circuit with the connection of the output terminals in series in closed loom form. The illumination units are connected between the secondary output terminals of the output transformer and the output terminal of the other output transformer of counter phase with the output terminal.

19 Claims, 17 Drawing Sheets

(A)

(B)

(C)

DRIVE CIRCUIT FOR ILLUMINATION UNIT

BACKGROUND OF THE INVENTION

The present invention relates to a drive circuit used for inverters or the like that drive an illumination unit such as a cold cathode fluorescent lamp or an EL display (electroluminescence display) and the like.

Heretofore, a ballastless type discharge lamp drive circuit using a multilamp leakage transformer as a circuit for driving a plurality of discharge lamps has been known (for example, refer to official gazette of Japan Tokkai 2002-075756). Furthermore, a discharge lamp drive circuit has been developed which drives by connecting primary sides of a plurality of output transformers in parallel and connecting the discharge lamps to the secondary sides of each output transformer.

Furthermore, heretofore, in case where an illumination unit, such as a plurality of cold cathode fluorescent lamps, is driven by using a high tension terminal at a secondary side of the wound transformer of one input and two outputs, as shown in FIG. 17, primary sides of each transformer T1, T2, T3 are connected in parallel, and the illumination units L1–L6 are connected independently to each transformer T1, T2, T3, as shown in the drawing.

In case where the primary sides of a plurality of output transformers are connected in parallel, and the lamps, such as the cold cathode fluorescent lamps, are driven for each output transformer, dispersion occurs in characteristics of the output transformer or the load even if they are of the same standard, and dispersion occurs in brightness of the lamps connected to each output transformer due to the foregoing dispersion.

An object of the present invention is to solve the foregoing problems.

Furthermore, in case of driving a plurality of the lamps, a system of connecting the electrode of the one lamp to the high tension terminal at the secondary side of the output transformer and driving the lamp by connecting the other electrode to the earth is generally employed. This system, however, has drawbacks such as causing a potential difference at both terminals of the lamp due to the one terminal side of the lamp being earthed that results in lower voltage of one terminal side of the lamp, and the high tension terminal connection side of the output transformer becomes bright, and the earth side becomes darker, and furthermore, dispersion occurs in luminance between the lamps.

Another object of the present invention is to solve the foregoing problems.

SUMMARY OF THE INVENTION

The present invention drives a plurality of illumination units by high tension output that is induced at a secondary side of each transformer by connecting each primary side of a plurality of output transformers of the same standard of a type that one input against plural outputs to each other, and inputting an AC signal to the primary sides. Among the plural illumination units, the electrodes of one side of the plural illumination units where one or mutually connected in series are connected to the high tension terminals at the secondary side of the output transformer of the one part, and the electrode of the other side of the plural illumination units that one piece or mutually serially connected are connected to the other secondary side high tension output terminals of the other part of the pair of output terminals.

Furthermore, the present invention relates to a drive circuit for an illumination unit for lighting a plurality of illumination units by high tension output induced at the secondary side of each output transformer by connecting the primary sides of output transformers of one input and plural outputs and connecting the illumination units to the secondary sides of each output transformer, and a loop circuit is formed by connecting in a closed loop serially so that all the secondary output terminals of each output transformer are connected to the secondary output terminals of counter phases, and an illumination unit is connected between the secondary output terminal of the output transformer and the output terminal of the other output transformer in counter phase with the output terminal.

When the foregoing construction is formed, the dispersion of characteristics of the secondary side of each output transformer can be reduced to a minimum, and the dispersion of brightness of the plural illumination units connected to each output terminal can be reduced to a minimum.

DETAILED DESCRIPTION OF THE INVENTION

An embodiment of the present invention will be described in the following by referring to attached drawings.

Figure 1:
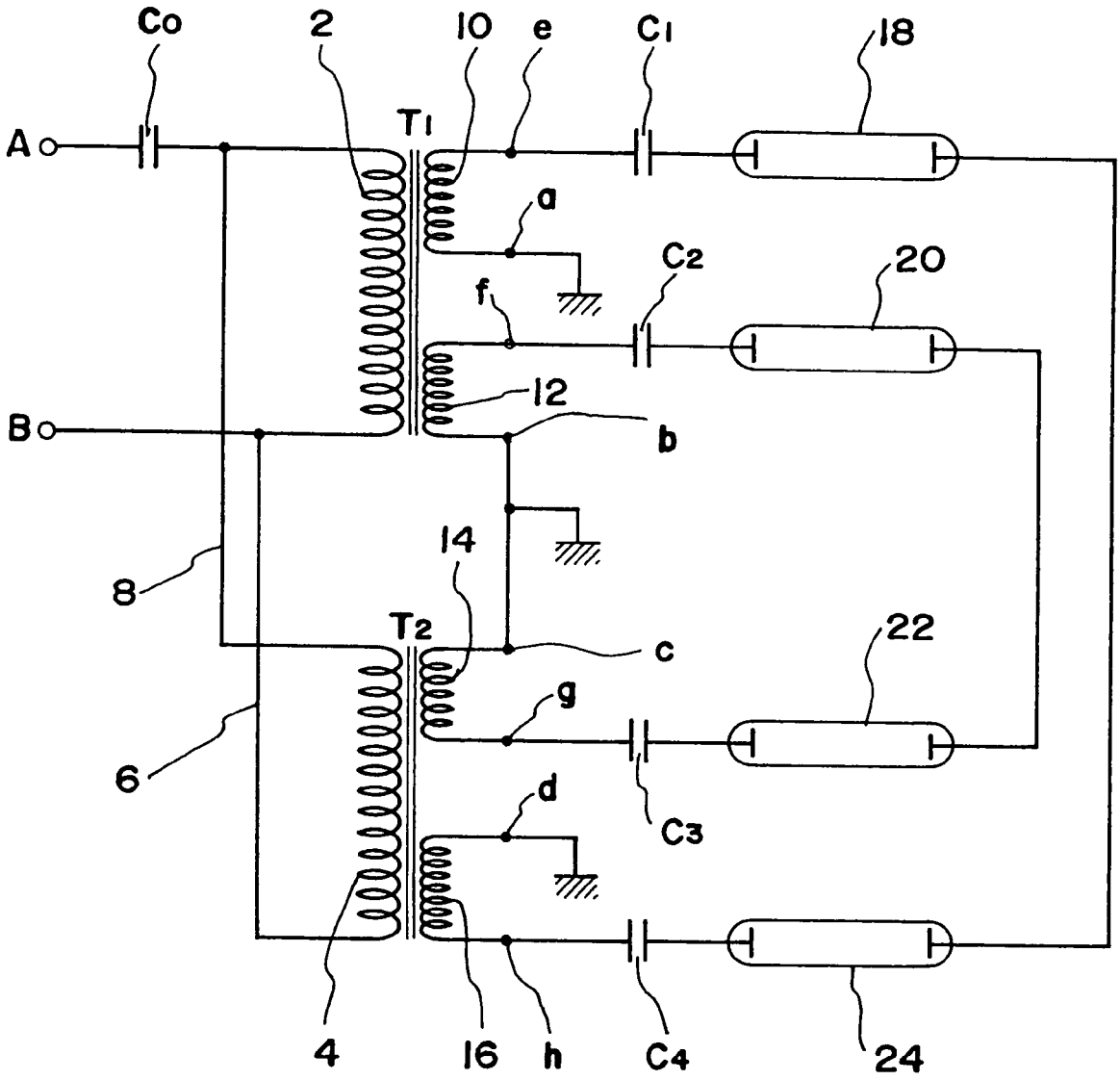
FIG. 1 denotes a circuit diagram of the illumination unit drive circuit according to the present invention.

In FIG. 1, T1 and T2 denote output transformers for high tension of identical structure and identical standard wherein one input and two outputs of wound type are provided, and input windings 2 and 4 at a primary side are connected in parallel by lead wires 6 and 8. A series resonance circuit is formed by a resonance capacitor Co and L of a primary winding 2 between input terminals A and B of the output transformer T1. The input terminals A and B are connected to an inverter circuit, and AC voltage to be outputted from the inverter circuit is inputted to the input terminals A and B. Each terminal a, b, c, d of secondary windings 10, 12, 14, 16 of each output transformer T1 and T2 are connected to the earth by means of the terminals.

Reference numerals 18 and 24 denote cold cathode fluorescent lamps, and the lamps are connected serially to each other. An electrode of one terminal of the lamp 18 is connected to a high tension terminal e of the secondary winding 10 of the output transformer T1 by means of the ballast capacitor C1. One electrode of the lamp 24 is connected to a high tension terminal h of the secondary winding of the output transformer T2 by means of the ballast capacitor C4. The terminal e and the terminal h are mutually in counter phase relation. Numerals 20, 22 denote a pair of cold cathode fluorescent lamps connected in series mutually and the electrode of one end of the lamp 20 is connected to a high tension terminal f of the secondary winding 12 of the output trnasformer T1 by means of the ballast capacitor C2. The electrode of one terminal of the lamp 22 is connected to a high tension terminal g of the secondary winding of the output transformer T2 by means of the ballast capacitor C3. The terminal f and the terminal g are mutually in a counter phase relation.

In the foregoing construction, when AC voltage is inputted to the input terminals A and B, and AC voltage of high tension is induced at the secondary side of the output transformers T1 and T2, the high tension AC voltage is impressed at both terminals of each lamp 18, 20, 22 and 24, and the light is on in each lamp 18, 20, 22 and 24. There is no occurrence of dispersion of shade since the high tension is impressed at both terminals of each lamp. Furthermore, at this time, even if there is dispersion in characteristics of the output transformers T1, T2, lamps, ballast capacitors and the like, the dispersion in characteristics between the output transformers T1 and T2 disappears as the secondary sides of the output transformers T1 and T2 are mutually connected that produce a relevance. On account of the cancellation of the dispersion, four pieces of the lamps 18, 20, 22, 24 are operated by standardized characteristics at the secondary side of the output transformers T1 and T2, whereby there is no difference in the brightness between each lamp 18, 20, 22 and 24.

In the foregoing embodiment, an example of using the wound transformer of a 1 input-2 output as the output transformer with use of cold cathode fluorescent lamps as the load has been explained, however, the embodiments are not particularly limited to this construction. As the output transformer, a plural output types may be used as the output transformer, and as the load, the illumination unit such as the EL display or hot cathode fluorescent lamp and the like can be used. Furthermore, the output transformer is not particularly limited to the 1 input-2 output type, and as shown in FIG. 2, a wound type one input, multiple output transformer may be used.

Figure 2:
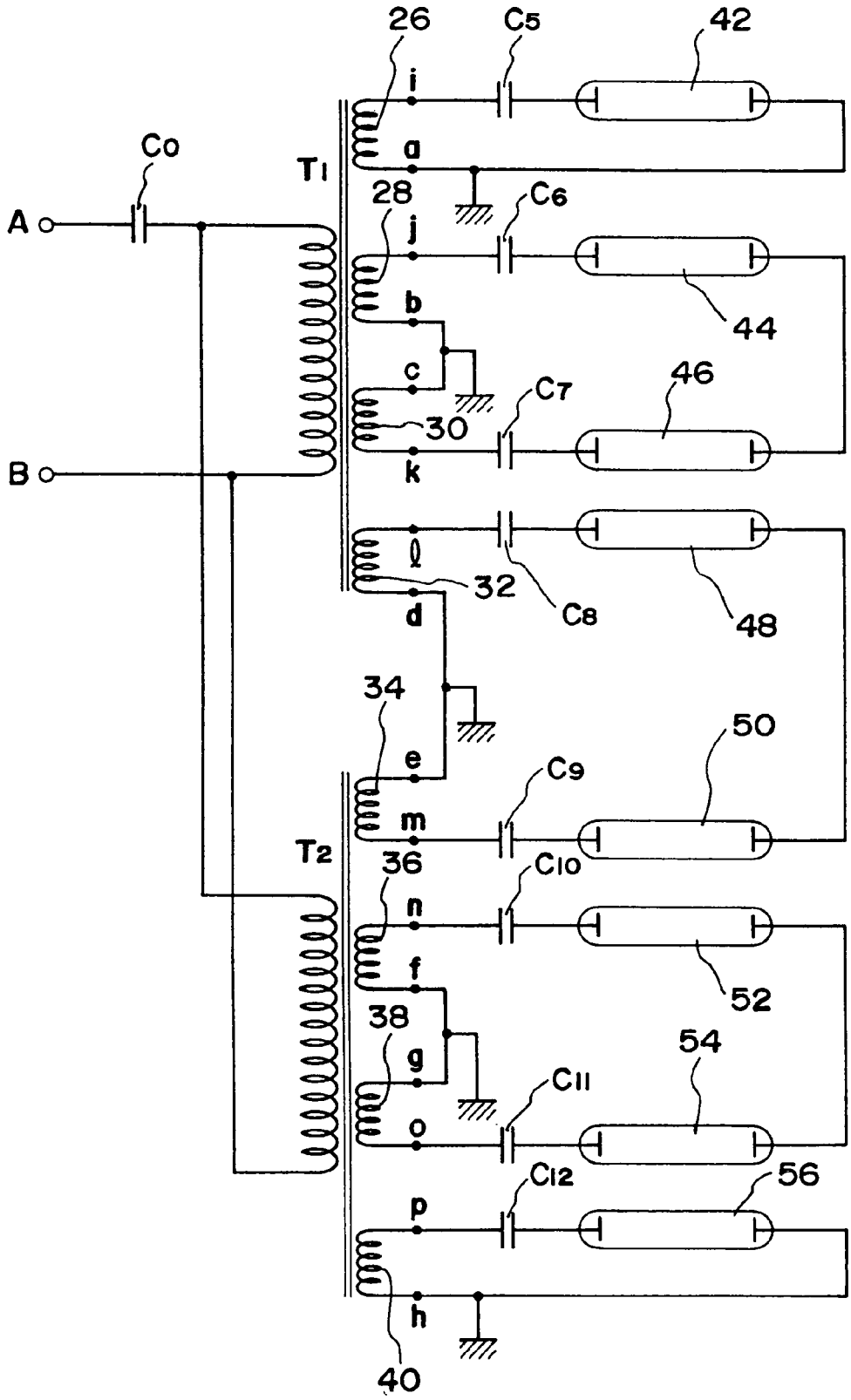
FIG. 2 denotes a circuit diagram of another embodiment of the present invention.

In FIG. 2, T1 and T2 are 1 input-4 output type high tension transformers of wound type of identical structure and identical standard, wherein primary sides are mutually connected in parallel, and eight pieces of the cold cathode fluorescent lamps 42, 44, 46, 48, 50, 52, 54, 56 are connected to the secondary sides thereof as per the drawing.

The lamps 44, 46 are connected in series, and one electrode of lamp 44 is connected to the high tension terminal j of the secondary winding 28 of the output transformer T1 by means of the ballast capacitor C6, and the other electrode of the lamp 34 is connected to the high tension terminal k of the secondary winding 30 of the output transformer T1 by means of the ballast capacitor C7. The high tension terminal j and the high tension terminal k are mutually in a counter phase relation. Of the lamps 52 and 54 which are connected in series, one electrode of the lamp 52 is connected to the high tension terminal n of the secondary winding 36 of the output transformer T2 by means of the ballast capacitor 10, and the other electrode of the lamp 54 is connected to the high tension terminal o of the secondary winding 38 of the output transformer T2 by means of the ballast capacitor C11. The high tension terminal m and the high tension terminal o are mutually in a counter phase relation. The low tension terminals f, g of the secondary windings 36, 38 of the output transformer T2 are connected to the earth, and the low tension terminals b, c of the secondary windings 28, 30 of the output transformer T1 are connected to the earth.

One electrode of the lamp 42 is connected to a high tension terminal i of the secondary winding 26 of the output transformer T1 by means of the ballast capacitor C5, and the other electrode is connected to a ground terminal c of low tension side of the secondary winding 26 of the output transformer T1. One electrode of the lamp 56 is connected to a high tension terminal p of the secondary winding 40 of the output transformer T2 by means of the ballast capacitor C12, and the other electrode is connected to a low tension terminal h of the secondary winding 40 which is grounded. One electrode of the lamp 48 among the lamps 48, 50 which are connected in series is connected to a high tension terminal 1 of the secondary winding 32 of the output transformer T1, and one electrode of the lamp 50 is connected to a high tension terminal m of the secondary winding 34 of the output transformer T2 by means of the ballast capacitor C9. The high tension terminal 1 and the high tension terminal m are in mutually counter phase relation. The low tension terminals d, e of the secondary windings 32, 34 of the output transformers T1 and T2 are grounded.

In the foregoing construction, in case the secondary side of the output transformers T1 and T2 are connected by means of the lamps 48, 50, the mutual characteristics are standardized and the dispersions of each characteristics are eliminated. By this arrangement, the lamps 42, 44, 46, 48, 50, 52, 54, 56 that are driven by the secondary side of the output transformers T1 and T2 are illuminated with the brightness of almost the same degree mutually.

Figure 3:
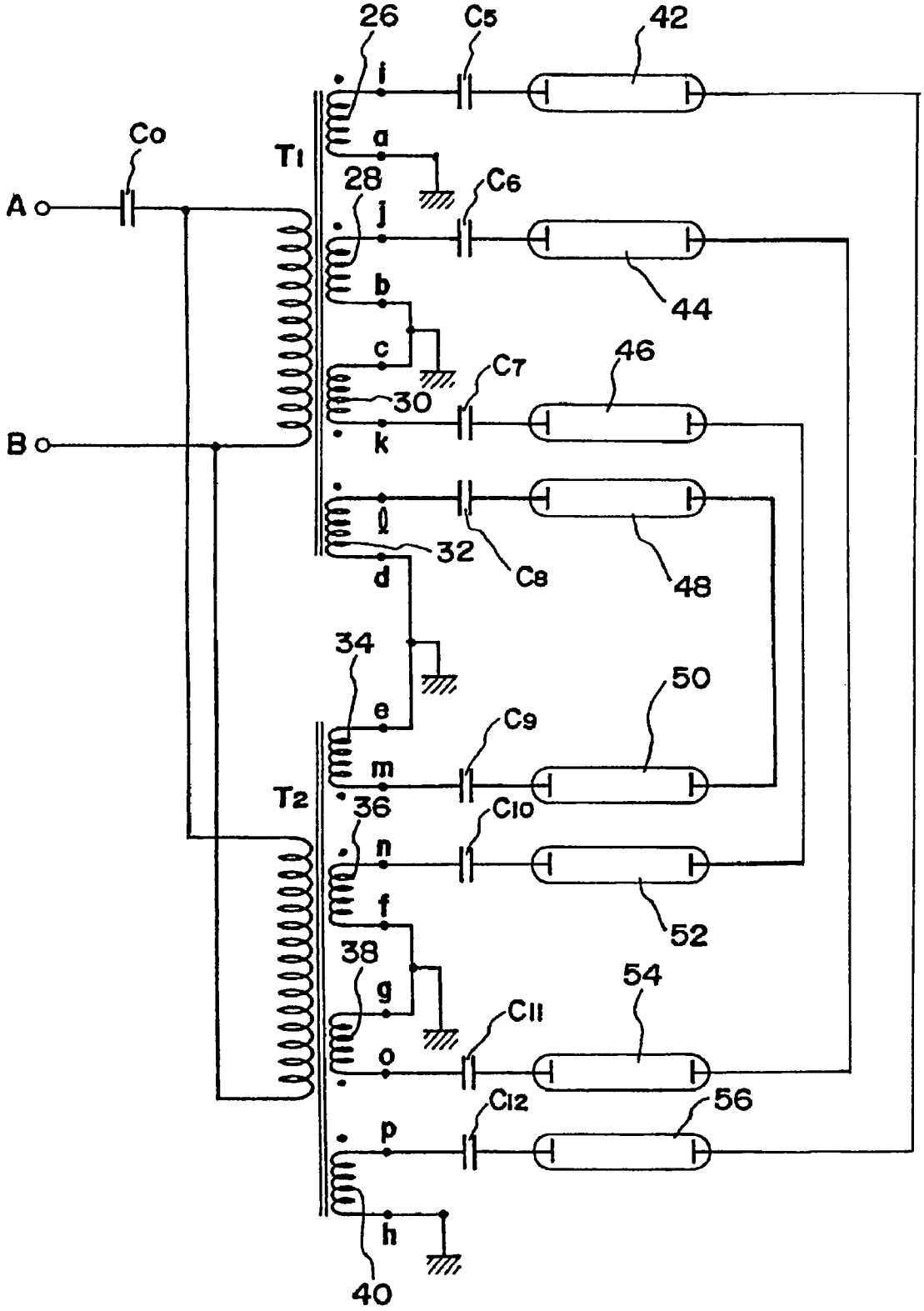
FIG. 3 denotes a circuit diagram of another embodiment of the present invention.

FIG. 3 denotes a modified example of the embodiment illustrated in FIG. 2.

In FIG. 3, T1 and T2 denote 1 input-4 output type high tension output transformers of wound type of identical structure and identical standard, the mutual primary sides being connected in parallel, and eight pieces of cold cathode fluorescent lamps 42, 44, 46, 48, 50, 52, 54, 56 are connected as shown in the drawing to each secondary side thereof.

The lamps 42, 56 are connected in series, and one electrode of the lamp 42 is connected to a high tension terminal i of the secondary winding 26 of the output transformer T1 by means of the ballast capacitor C5, and one electrode of the lamp 56 is connected to a high tension terminal p of the secondary winding 40 of the output transformer T1 by means of the ballast capacitor C12. The high tension terminal i and the high tension terminal p are in mutually counter phase relation. Among the lamps 44 and 52 that are connected in series, one electrode of the lamp 44 is connected to a high tension terminal j of the secondary winding 28 of the output transformer T1 by means of the ballast capacitor. C6, and one electrode of the lamp 54 is connected to a high tension terminal o of the secondary winding 38 of the output transformer T2 by means of the ballast capacitor C11. The high tension terminal j and the high tension terminal o are in mutually counter phase relation.

One part of the electrodes of the serially connected lamps 46, 52 are connected to a high tension terminal k of the secondary winding 30 of the output transformer T1 by means of the ballast capacitor C7, and the other electrodes are connected to a high tension terminal n of the secondary winding 36 of the output transformer T2 by means of the ballast capacitor C10. One part of the electrodes of the lamps 48, 50 which are connected in series are connected to a high tension terminal 1 of the secondary winding 32 of the output transformer T2 by means of the ballast capacitor C9, and the other electrode is connected to a high tension terminal m of the secondary winding 34 of the output transformer T2 by means of the ballast capacitor C9. The high tension terminal k and the high tension terminal n, high tension terminals 1 and m are mutually in counter phase relation. The low tension terminals a, b, c, d, e, f, g, h, of the secondary windings 32, 34 of the output transformers T1 and T2 are grounded.

In the foregoing construction, the mutual character-istics are standardized by the connection of the secondary side of the output transformers T1 and T2 by means of the lamps 42, 56, 44, 54, 46, 52, 50, and the dispersion of each characteristic is eliminated. With this construction, the lamps 42, 44, 46, 48, 50, 52, 54, 56 which are driven by the secondary side of the output transformers T1 and T2 are illuminated mutually with almost the same brightness.

Another embodiment of the present invention will be explained in the following by referring to FIG. 4.

Figure 4:
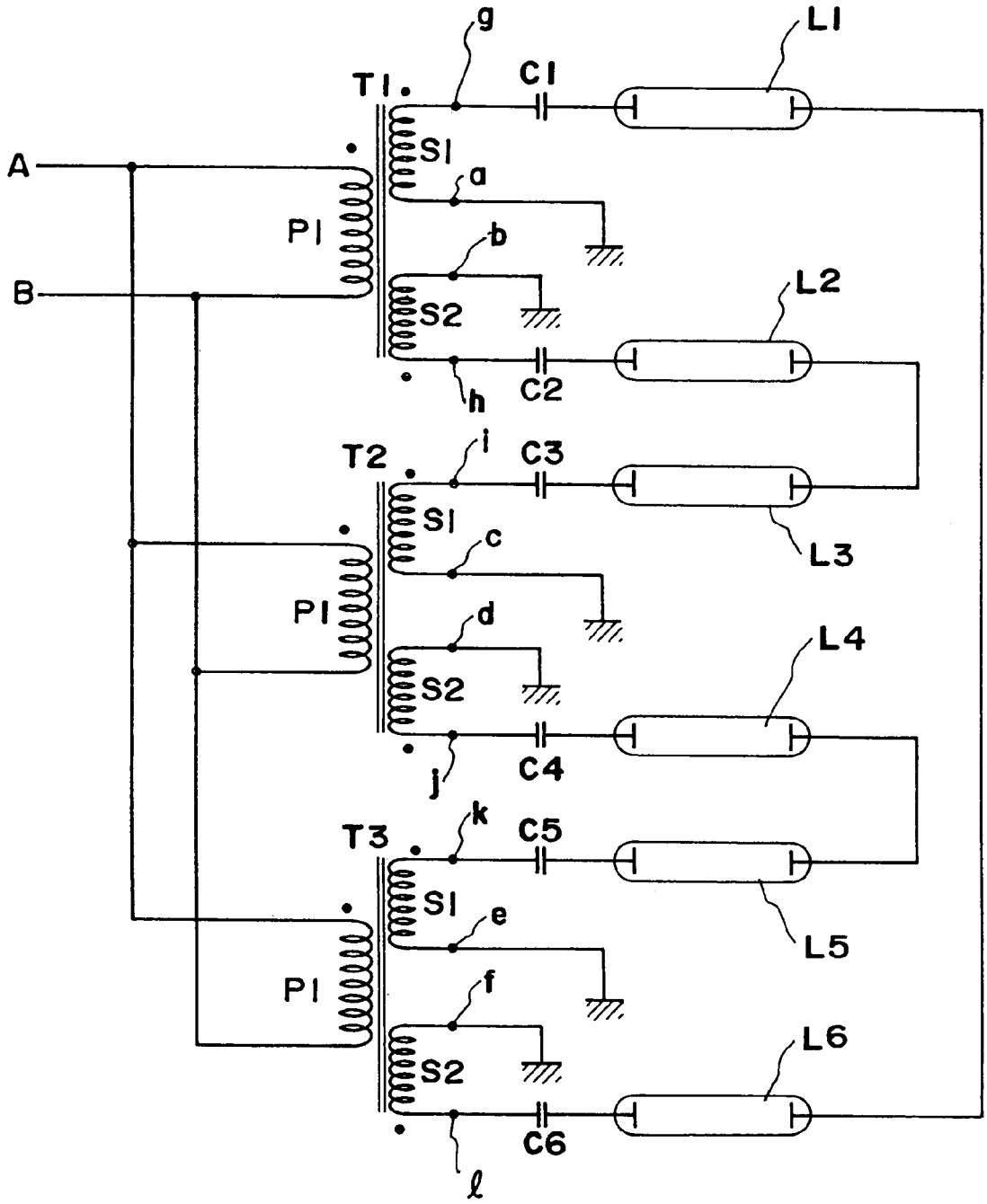
FIG. 4 denotes a circuit diagram of another embodiment of the present invention.

In FIG. 4, T1, T2 and T3 denote output transformers for high tension of 1 input-2 output type of identical structure and identical standard, and an input winding P1 at the primary side of each transformer are connected in parallel by lead wires. The input terminals A and B of output transformer T1 are connected to, for example, a parallel resonance inverter circuit of the layer system, series resonance inverter circuit, separately excited inverter circuit that supply AC signals to the primary side of the output transformer T1. The low tension side terminals a, b, c, d, e, f, for connection to each winding terminal of the secondary windings S1, S2 of each output transformer T1, T2, T3 are connected to the earth.

L1, L6 denote cold cathode fluorescent lamps, and the lamps are mutually connected in series. One electrode of the cold cathode fluorescent lamp L1 is connected to a high tension side terminal g for connection to a winding start end of the secondary winding S1 of the output transformer T1 by means of the ballast capacitor C1, and one electrode of the cold cathode lamp L6 is connected to low tension side terminal 1 connected to a winding start end of secondary winding S2 of the output transformer T3 by means of the ballast capacitor C6. One electrode of lamp L2, among a pair of lamps L2, L3 which are connected mutually in series, is connected to a high tension side terminal h for connection to the winding start end of the secondary winding S2 of the output transformer T1 by means of ballast capacitor C2, and one electrode of the other lamp L3 is connected to high tension side terminal i connected to a winding start end of secondary winding S1 of output transformer T2 by means of the ballast capacitor C3. The electrode of the lamp L4 among the lamps L4, L5 of mutual serial connection is connected to high tension side terminal j for connection to a winding start end of the secondary winding S2 of output transformer T2 by means of ballast capacitor C4, and the electrode of the lamp L5 is connected to high tension side terminal k connected to a winding start end of secondary winding S1 of output trans-former T3 by means of ballast capacitor C5. High tension side terminals g and h and i and j and k and 1 of each output transformer T1, T2, T3 are mutually in the counter phase relation, and connecting points of the lamps L1 and L6 and L2 and L3, L4 and L5 become apparently zero volts.

In the foregoing construction, when an AC signal is inputted to the primary side of the output transformers T1, T2, T3 from the input terminals A and B, and an AC voltage of high tension is induced at the secondary side of the output transformers T1, T2 and T3, the high tension AC voltage is impressed to both terminals of each lamp L1, L6, L2, L3, L4, L5. At both terminals of the secondary windings S1 and S2 of each output transformer T1, T2, T3, a voltage is generated corresponding to an impedance of total including load connected to both windings. At this time, for example, at the secondary winding S2 of the output transformer T1 and the secondary winding S1 of the output transformer T2, the related voltage generates by means of the lamps L2,L3 connected in series. Similarly, at both the terminals of the secondary winding S1 of the output transformer T1 and the secondary winding S2 of the output transformer T3, the related voltage generates by means of the lamps L1 and L6 connected in series. Furthermore, at both terminals of the secondary winding S2 of the output transformer T2 and the secondary winding S1 of the output transformer T3, the related voltage generates by means of the lamps L4 and L5. By this arrangement, all of the output transformers T1, T2 and T3 are caused to co-relate to flow a uniform electric current through all the lamps L1–L6 to maintain a uniform brightness. This means that the related voltage generates in the secondary windings S1 and S2 of each output transformer T1, T2, T3 even if there is dispersion in the load impedance of the output transformers T1, T2 and T3. Furthermore, at this time, when the potential difference occurs in the secondary windings S1 and S2, an operation of shunt trans in the windings of S1 and S2 which causes the electric current energizing in the secondary windings S1 and S2 to be the same current, and electric current correction of secondary windings S1 and S2 takes place. By the foregoing operation, all the lamps L1–L6 light up with the same brightness. Furthermore, even if the constant of the impedance parts of the lamps changes due to temperature change, stable brightness can be provided for each of the lamps L1–L6 by the foregoing operation.

As described in the foregoing, the voltage at both terminals of the secondary windings S1 and S2 of each output transformer becomes uniform whereby the voltage of the winding P1 of the primary side of each output transformer T1, T2 and T3 becomes almost the same value, and thus, stabilized lamp driving becomes possible. At the primary side of each of the output transformer, voltage is generated corresponding to the winding ratio of the primary and secondary windings. Namely, the voltage of a fraction of winding number of the voltage generated in the secondary winding generates, and this means that if the voltages at the secondary side of the output transformers T1, T2 and T3 are respectively equal, the voltage at the primary side of each of the output transformers becomes equal, and the supplied electric power becomes the same. For reference, in the mode of this embodiment, the lamps are not limited particularly to the cold cathode fluorescent lamp, and also, the output transformers are not particularly limited to the wound type, and can be used for piezoelectric transformers and the like.

Figure 5:
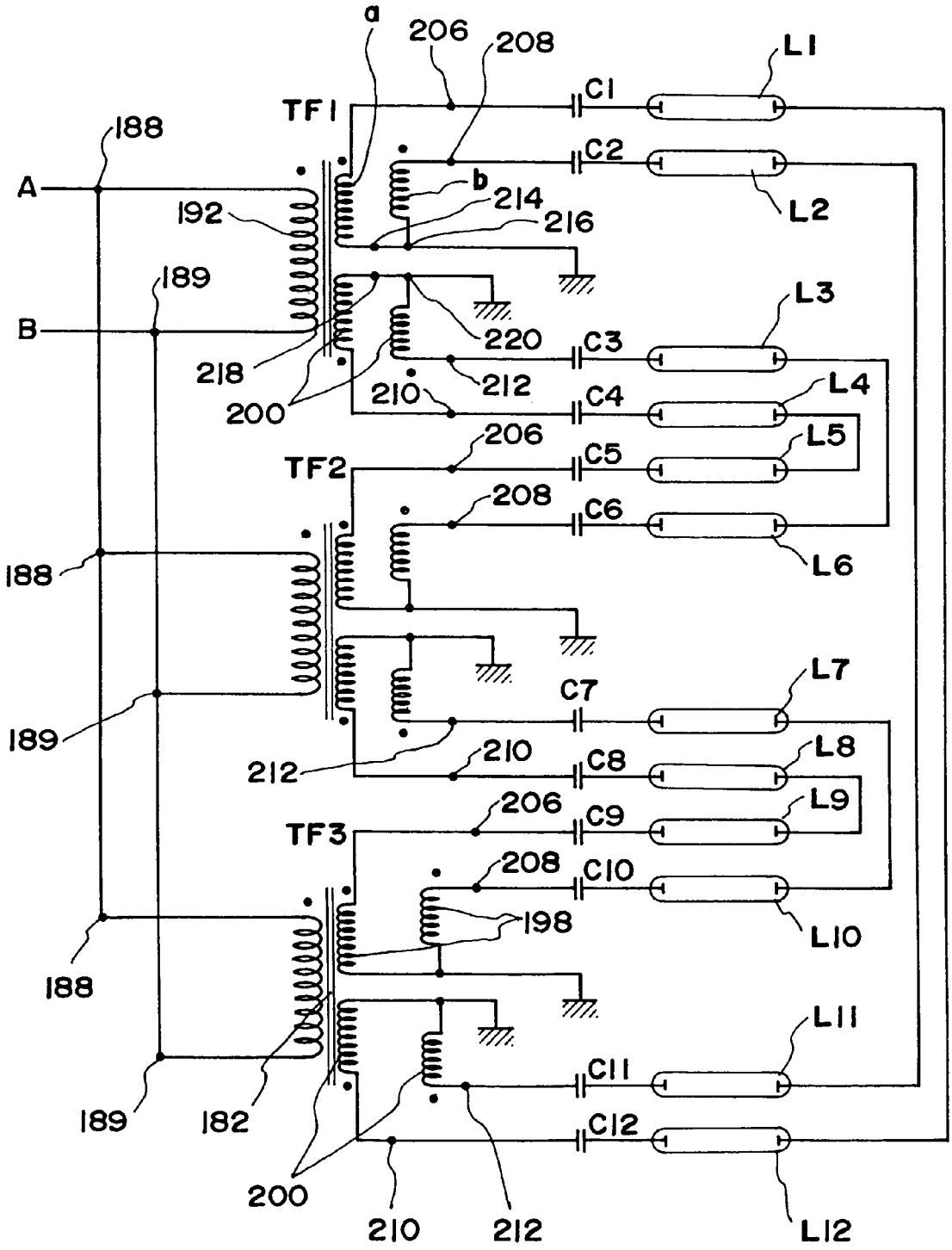
FIG. 5 denotes a circuit diagram of another embodiment of the present invention.
Figure 6:
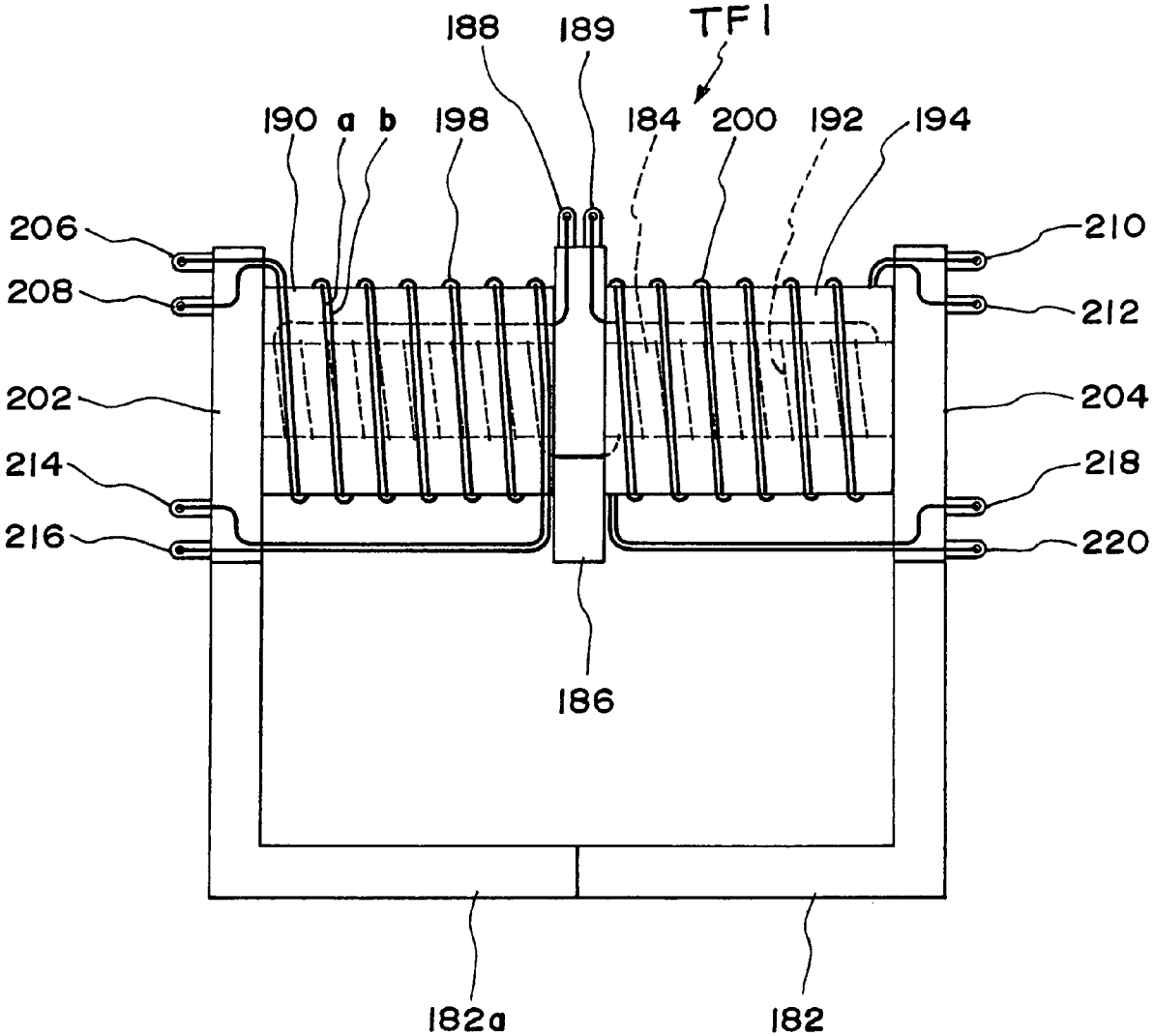
FIG. 6 denotes a plane explanatory drawing of a wound transformer.
Figure 7:
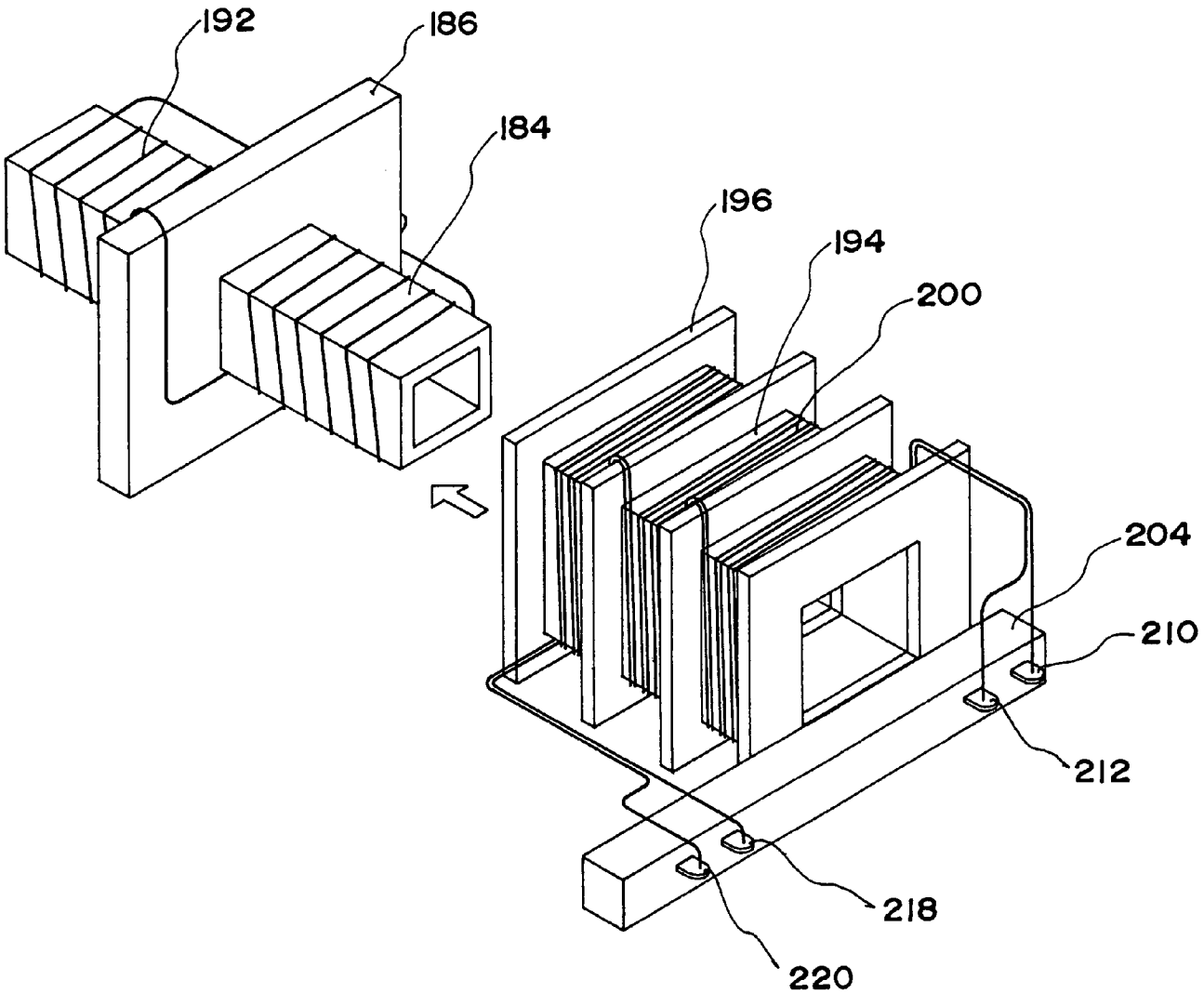
FIG. 7 denotes an exterior view of the wound. transformer.

FIG. 5 shows an embodiment wherein a secondary side is put to a bifilar winding (parallel winding), and three pieces of a plurality of transformers TF1, TF2 and TF3 with 1 input-4 output type are used, and twelve pieces of lamps L1–L12 are operated. FIGS. 6 and 7 show the transformer TF1 of 1 input 4 outputs of bifilar winding.

In FIG. 6, numeral 182 denotes a core, and a core is of shape formed by joining two pieces of □-shape core. On the part of parallel portion of the core 182, a bobbin 184 for primary is inserted and disposed. In the center of the bobbin 184 for primary, a terminal base 186 is fixed, and primary input terminals 188 and 190 are provided on the terminal base. On the bobbin 184, a primary winding 192 is wound, and both terminals of the primary winding 192 are connected to the primary input terminals 188 and 190 by means of a lead wire.

To the outside of the bobbin 184 for primary, a pair of bobbins 191 and 194 for secondary are inserted and disposed by being positioned at both sides of the terminal base 186. A partition 196 at one end of the bobbins 191, 194 for secondary abuts on both sides of the terminal base 186. In FIG. 6, the partition 196 of the secondary bobbins 191, 194 is omitted from the drawing in order to avoid complication of the drawing. On the bobbins 191, 194 for secondary, secondary windings 198, 200 are wound with two pieces of wires a, b which are superposed. The winding start of the secondary windings 198, 200 made of double wires is connected to secondary high tension terminals 106, 208, 210, 212 provided on each terminal base 202, 204 of the secondary bobbins 191, 194, and the winding finish end is connected to ground terminals 214, 216, 218, 220 by means of lead wires.

In the foregoing construction, the relationship of the primary winding 192 and the secondary windings 198 and 200 is such that in the double layer structure of the bobbins, the secondary winding 198 and 200 are disposed at both sides of the primary winding, which produces multiple outputs by a simple structure. In this embodiment, high tension may be exerted on the double parallel wires forming the secondary winding but this high tension is of mutually identical electric potentials so that there is no chance of causing shorting or leakage of electric current in the parallel secondary windings. Furthermore, the other parallel portion 182*a* of the core 182 can be constituted similarly, and in case of making it like a vertical symmetrical structure, the primary side is made as one input by connecting them in series or parallel, and thus, eight outputs can be materialized. Furthermore, multiple outputs can be arranged by making the numbers of windings of the secondary windings to be three pieces or four pieces. In FIG. 5, TF1, TF2, TF3 show that input terminals 188, 189 at the primary side are connected in parallel by the lead wires. The input terminals 188, 189 of the output transformer TF1 are connected to, for example, parallel resonance inverter circuit of layer type, series resonance inverter circuit, separate excitation type inverter circuit are connected which supplies AC signals to primary side of the output transformer TF1. Low tension side terminals 214, 216, 218, 220 which are connected to each winding end of the secondary windings 198, 200 of each output transformer TF1, TF2, TF3 are connected to the earth. L1 and L2, L2 and L11 are cold cathode fluorescent lamps, and the lamps are connected mutually in series. One part of the electrodes of the cold cathode fluorescent lamps L1, L2 are connected to high tension side terminals 206, 208 connected to the winding start end of the secondary winding of the output transformer TF1 by means of the ballast capacitors C1, C2, and one part of the electrodes of the cold cathode fluorescent lamps L12, L11 are connected to high tension side terminals 210, 212 connected to the winding start end of the secondary winding of the output transformer TF3 by means of the ballast capacitors C12, C11. Among a pair of lamps L3, L6 and a pair of lamps L4, L5, which are mutually and serially connected, one part of electrodes of one part of the lamps L3, L4 are connected to the high tension side terminals 212, 210 connected to the winding start end of the secondary winding 200 of the output transformer FT1 by means of the ballast capacitors C3, C4, and one part of electrodes of the other part of the lamps L5 and L6 are connected to the high tension side terminals 206, 208 connected to the winding start end of the secondary winding of the output transformer TF2 by means of the ballast capacitors C5, C6.

Among a pair of lamps L7, L10 and a pair of lamps L8, L9, which are mutually and serially connected, one part of electrodes of one part of the lamps L7, L8 are connected to the high tension side terminals 212, 210 connected to the high tension side terminals 212, 210 by means of the ballast capacitors C7, C8, and one part of the electrodes of the other lamps L9, L10 are connected to high tension side terminals 206, 208 connected to the winding start end of the secondary winding of the output transformer TF3 by means of the ballast capacitors C9, C10. The high tension side terminals 206, 208 of each of the output transformers TF1, TF2, TF3 and the high tension side terminals 210, 212 are in counter phase relation with respect to each other, and connecting points of the lamps L1 and L2, L2 and L11, and L3 and L6, and L4 and L5, and L7 and L10, L8 and L9 become apparently zero volts. For reference, in this embodiment, the lamps are not limited particularly to the anode cathode lamps and also are not limited to the output transformers or to the wound type, and the piezoelectric transformers and the like may be used.

In the foregoing construction, when the AC signals are inputted to the the primary side of the output transformers TF1, TF2, TF3 from the input terminals A and B of the circuit, and the AC voltage of high tension is induced at the secondary side of the output transformers TF1, TF2, TF3, the high tension AC voltage is impressed to each terminal of each lamp L1, L12, L2, L11, L3, L6, L4, L5, L7, L10, L8, and L9. The voltage corresponding to the impedance of the total including the load connected to both terminals of thewindings generates at both terminals of the secondary windings 198, 200 of each output transformer TF1, TF2, TF3. At this time, the related voltage generates by means of the lamps L2, L5 and L4 and L5 which are connected in series generates, for example, at the secondary winding 200 of the output transformer TF1 and the secondary winding 198 of the output transformer TF2. Similarly, the related voltage by means of the serially connected lamps Li, L2 and L11, L12 generates at both terminals of the secondary winding 198 of the output transformer TF1 and the secondary winding 200 of the output transformer TF3. Also, the related voltage by means of the lamps L7, L10, L8, L9 generate at both terminals of the secondary winding 200 of the output transformer TF2 and of the secondary winding 198 of the output transformer TF3.

By this arrangement, all of the output transformers TF1, TF2, TF3 come to be related, and the uniform electric current flows in all of the lamps L1–L12, and the brightness becomes uniform. This arrangement means that even if there is dispersion, the related voltage generates at the secondary windings 198 and 200 of each output transformer TF1, TF2, TF3. Furthermore, when the voltage difference occurs in the secondary windings 198 and 200, the operation of the shunt transformer occurs in the secondary winding 198 and 200, and the electric current flowing in the secondary windings 198 and 200 tend to be the same which causes the electric current correction of the secondary windings 198 and 200. The electric current correction is taken place by the operation of the shunt transformer similarly between the windings a and b of the secondary winding 198, and the electric current correction is taken place by the operation of the shunt transformer similarly between the windings a and b of the secondary winding 200.

With the foregoing operation, all of the lamps L1–L12 are illuminated with the same brightness. Furthermore, the stable brightness can be obtained for each lamp L1–L12 by the foregoing operation even if the constant of the impedance of the lamps change by the change of temperatures. As described in the foregoing, when the voltages at both terminals of the secondary windings 198, 200 of each of the output transformers TF1, TF2, TF3 become uniform, whereby the voltages of the winding 192 at the primary sides of each of the output transformers TF1, TF2, F3 become the same value, the stable operation of the lamps can be feasible. At the primary side of each output transformer, voltage is generated corresponding to a ratio of windings of the primary and secondary windings. Namely, the voltage is generated which is a fraction of the number of windings of voltage generated at the secondary winding, and this means that if respective voltages at the secondary sides of the output transformers TF1, TF2, TF3 are almost equal, the voltages at the primary side of each output transformer becomes equal, and the supplied electric power becomes equal.

Figure 8:
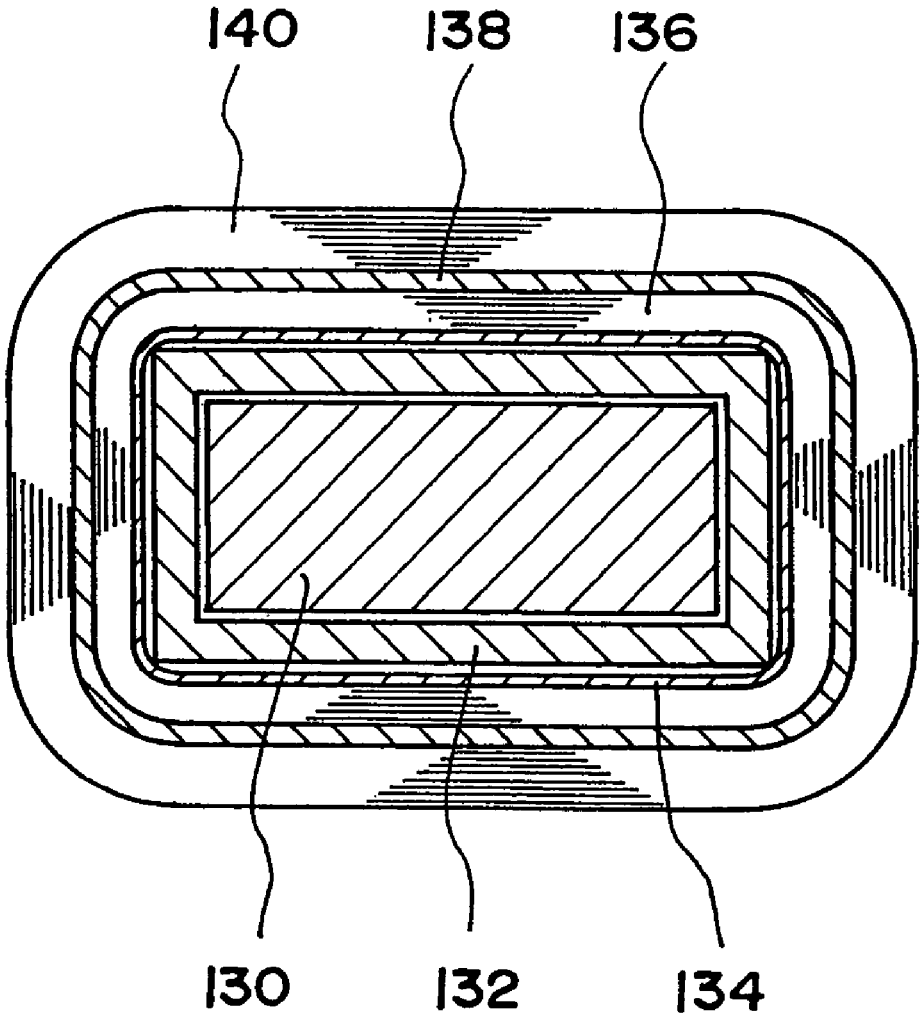
FIG. 8 denotes a cross section showing another embodiment of the parallel wound transformer.

FIG. 8 shows another embodiment of the parallel winding of the wire in the transformer. The first primary winding 136 is laminated on a bobbin 132 build in with a core 130 by means of an insulator 134 and the winding is wound, and the secondary winding 140 is laminated with the same number of winding with the first secondary winding 136 on the first secondary winding 136 by means of an insulator 138 and the winding is wound, and the first and the second secondary windings 136 and 140 corresponding to two pieces of the windings a and b of FIG. 5 may be formed in a lamination structure. For reference, the first secondary winding 136 may be formed in a bifilar winding consisting of more than two pieces of wires, and similarly, the second secondary winding 140 may be formed in a bifilar winding consisting of more than two pieces of wires. In FIG. 8, a 1 input-4 output wound type transformer may be produced by producing the secondary windings 136, 140 of the first and second with two pieces of wires respectively. The transformer of this lamination structure may be used in all of the embodiments of the present invention.

Figure 9:
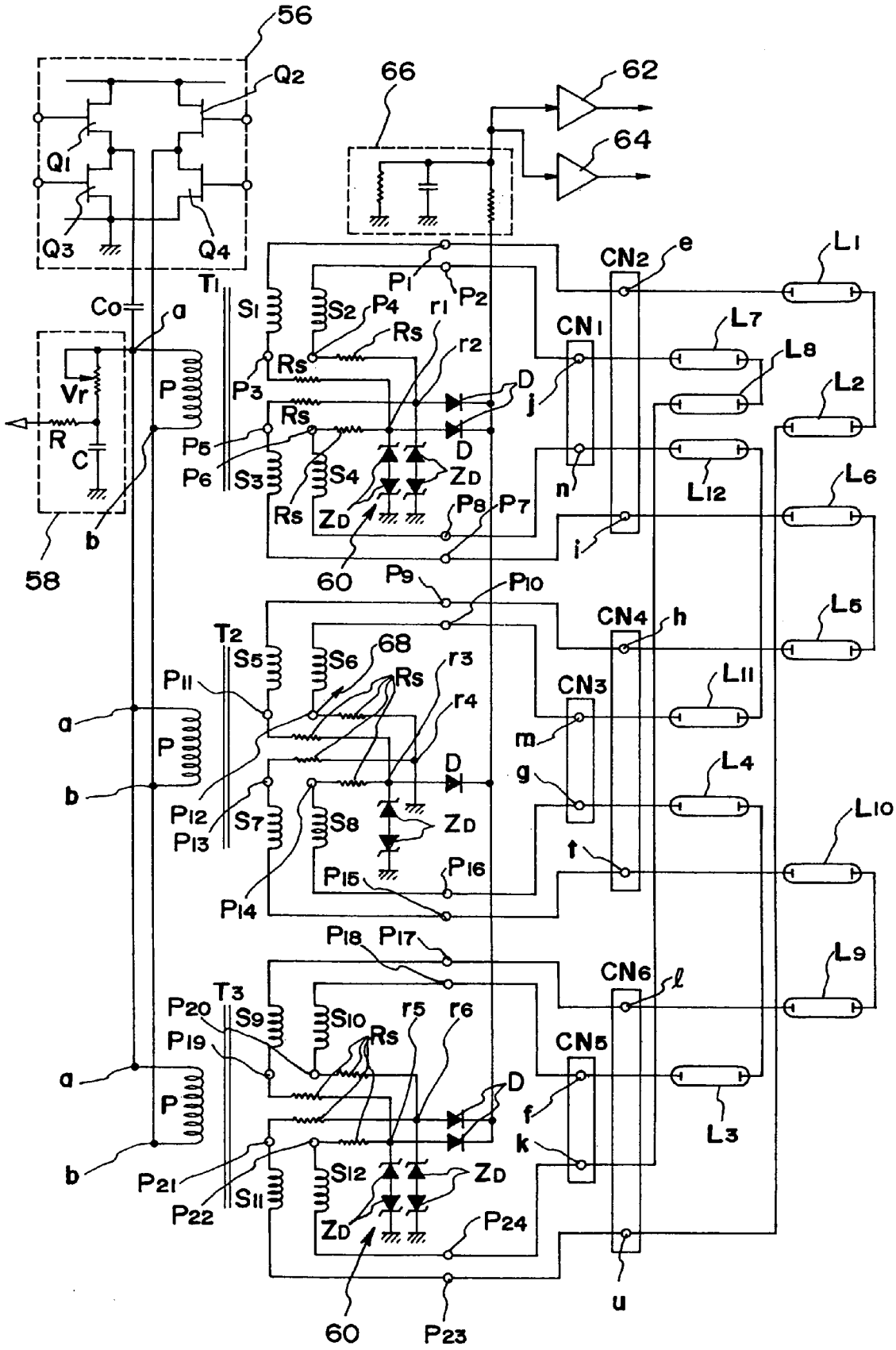
FIG. 9 denotes a circuit diagram showing another embodiment of the present invention.

Another embodiment of the present invention will be described in the following by referring to FIG. 9. In FIG. 9, the output transformers T1, T2, T3 show the 1 input-4 output type wound transformer with a secondary winding formed by winding with bifilar wound with the identical standard and identical core mutually, and the input terminals a, b at each primary side are connected in parallel with the lead wires. For reference, the foregoing output transformers T1, T2, T3 are limited particularly to the wound type transformer whose secondary windings are wound on the identical cores by the bifilar winding, and they may be wound on the different cores or any structure of transformers may be used as long as they are of the one input-plural output type transformers such as the piezo-electric transformers. The input terminals a, b of the output transformer T1 are connected to the output unit of a self-oscillation circuit 56 of bridge type consisting of four pieces of FETQ1, Q2, Q3, Q4 by means of the resonance capacitor Co. The resonance capacitor Co and the primary winding of the output transformer T1 are connected in series and an LC series resonance circuit is formed at the primary side of the output transformer T1.

A phase detecting circuit 58 is connected to an input terminal a positioned at a middle point of the LC series resonance circuit at the primary side of the output transformer, and a phase signal at the primary side of the output transformer T1 is supplied to the control unit (drawing is omitted) of the self-oscillation circuit 56 through the lead wires. For reference, a power source circuit for supplying an AC signal to the primary side of the output transformer T1 is not limited particularly to the self-oscillation circuit 56 of a full bridge type, and parallel resonance inverter circuit of a layer system, separately excited inverter circuit and the like can be used. Each output terminal of all coils S1–S12, a total of twelve pieces, at the secondary side of the output transformers T1, T2, T3 is connected mutually in series on a loop circuit forming a closed circuit. This loop circuit is constructed by a closed loop current path, based on one output terminal p1 of the coil S1 as a basis, and starting from this output terminal p1 and returning to another output terminal p3 of the coil S1.

The route of this loop circuit is formed by a closed loop starting with an output terminal pi, terminal e of terminal table CN2, lamp L1 (CCFL), lamp L2, coil S11, resistor Rs, resistor Rs, coil S10, terminal f of terminal table CN5, lamps L3, L4, terminal g of terminal table CN3, coil S8, resistor Rs, resistor Rs, coil S5, terminal i of terminal table CN2, coil S3, resistor Rs, resistor Rs, coil S2, terminal j of terminal table CN1, lamp L7, L8, terminal k of terminal table CN5, coil 512, resistor Rs, coil S9, terminal 1 of terminal table CN6, lamps L9, L10, coil S7, resistor Rs, resistor Rs, coil S6, terminal m of terminal table CN3, lamps L11, L12, terminal n of terminal table CN1, coil S4, resistor Rs, resistor Rs in this order, and is led to another output terminal P3 of the coil S1. Connecting points r1, r2, r3, r5, r6 of the coils of each output transformer T1, T2, T3 are connected to a voltage clamp circuit 60 formed by Zener diode ZD, Zd or surge absorber and the like respectively.

The connecting point r4 of the output transformer T2 is connected to the ground for receiving a lamp current detecting signal from a shunt resistor Rs to the lead wire 68. The connecting points r1, r2, r3, r5, r6 of each coil of each of the output transformer T1, T2, T3 are connected to each input terminal of a lamp open detecting comparator 62 and a lamp deterioration detecting comparator 64 by means of diode D and voltage detecting circuit 66. Output terminals p1, p2, p9, p10, p17, p18 of the output trans-formers T1, T2, T3 are of identical phase, and output terminal p7, p8, p15, p16, p23, p24 are in counter phase relative to the output terminals. Furthermore, output terminals p3, p4, p11, p12, p19, p20 are of mutually identical phase, and the output terminals p5, p6, p13, p14, p21, p22 are in counter phase to the output terminals. With this relationship, each connecting points of a pair of lamps and each connecting point r1–r6 of the coils which are mutually connected in series become apparent zero volts. The output terminals of the comparators 62, 64 are connected to the control unit of the self excitation oscillation circuit 56 thereof.

In the foregoing construction, when the AC signal is inputted to the primary side P of the output transformers T1, T2, T3 from the output unit of the self-oscillation circuit 56, and high tension is induced at the secondary side of the output transformers T1, T2, T3, identical current flows to each lamp L1–L12 through the loop circuit connecting the coils of each output transformer T1, T2, T3, and lights up each lamp L1–L12 with identical luminance. When disconnection occurs in any of the lamps or wiring on the loop circuit or in the wiring of the output transformers, high tension of several minutes of output of the output transformers T1, T2, T3 occurs in the loop circuit. When the high tension occurs, the voltage balance of the loop circuit is ill balanced, and voltage is generated exceeding the set Zener voltage. At this time, the loop circuit is connected to the ground through a voltage clamp circuit 60, and the loop circuit is clamped to a predetermined voltage. Thus, this arrangement prevents the generation of abnormal voltage in the loop circuit. On the other hand, when the abnormal voltage occurs in the connecting points r1–r6, this voltage signal is detected by a voltage detecting circuit 66 through a diode D, and this detecting signal is inputted to the comparators 62, 64. The comparator 62 outputs a lamp open detecting signal, and stops the driving of the self-oscillation circuit 56. Furthermore, when the lamps L1–L12 deteriorates, and the loop circuit is ill balanced, unbalanced current flows into the voltage clamp circuit 60 as a reactive power, and thus, the lamp deterio-ration signal is produced. This lamp deterioration signal is supplied to the comparator 64, and the comparator 64 outputs the lamp deterioration signal, and stops the self-oscillation circuit 56. For reference, in this embodiment, the primary side P of the output transformers T1, T2, T3 are respectively connected in parallel to the output unit of the self-oscillation circuit 56, but it is not particularly limited to this connecting system, and may be a serial connection.

Figure 10:
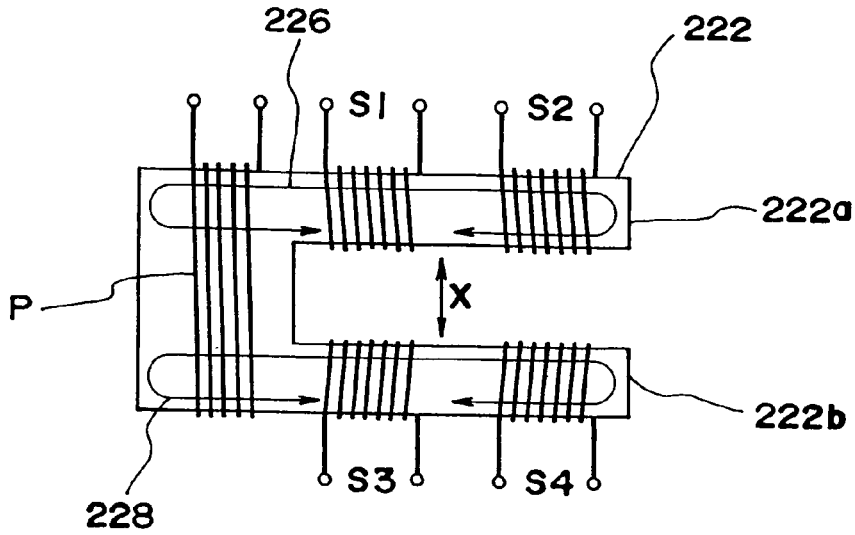
FIG. 10 denotes an explanatory drawing of an output transformer.
Figure 10:
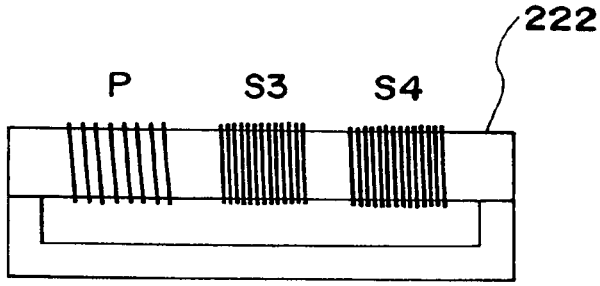
Figure 10:
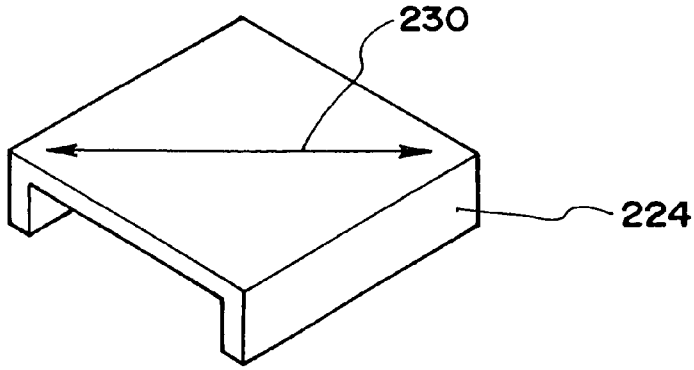
Figure 11:
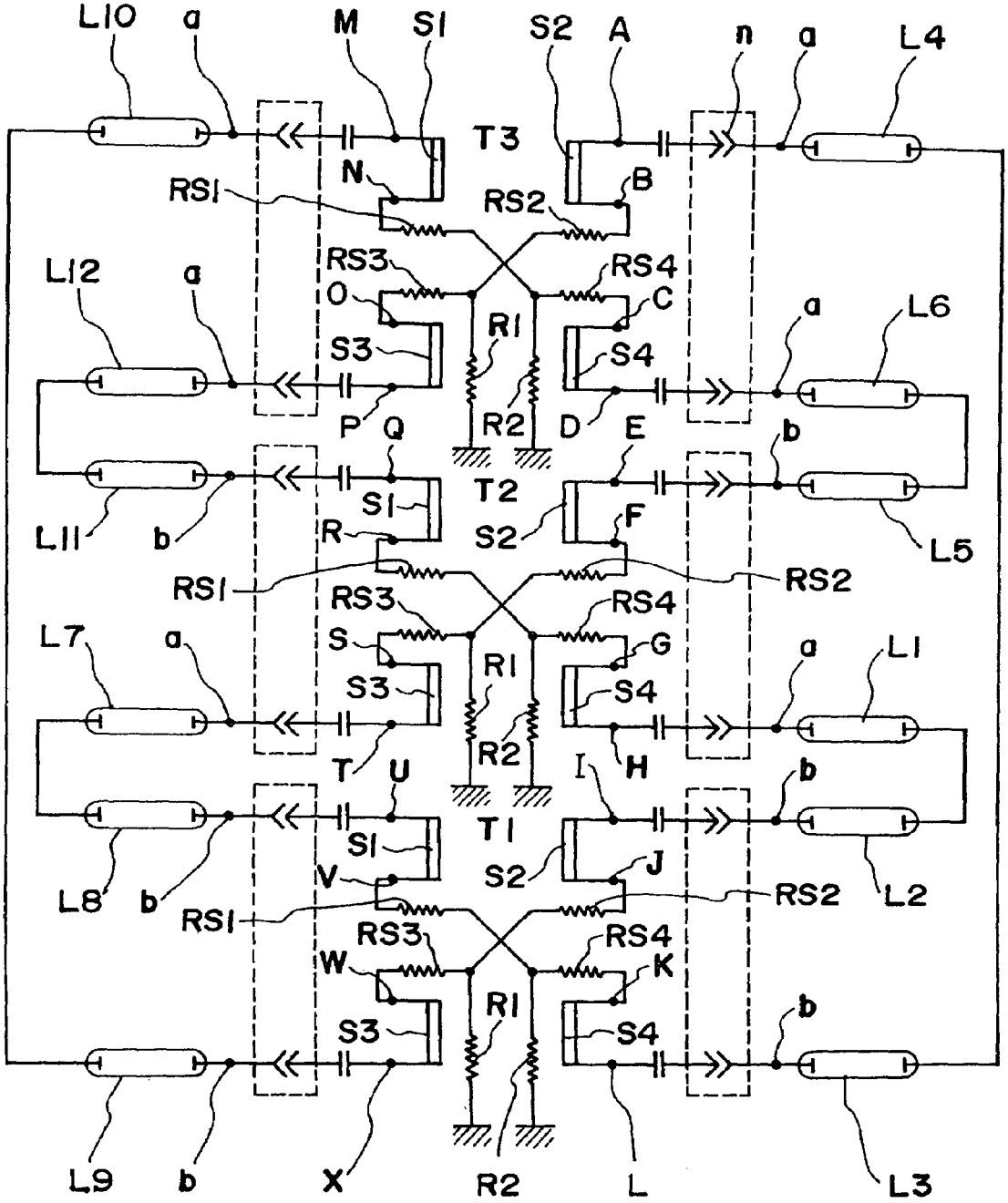
FIG. 11 denotes a circuit diagram showing another embodiment of the present invention.

FIG. 11 shows a modified example of the construction wherein a plurality of lamps are connected in loop form. The output transformers T1, T2, T3 are provided with an upper core 222 and a lower core 224 of U-shape as shown in FIG. 10, and the upper core 222 is provided with a primary coil P and four pieces of secondary coils S1, S2, S3, and S4. The secondary coils S1, S2 and S3, S4 may be formed in a parallel winding as shown in FIG. 6 respectively. In FIG. 11, the primary side of the output transformers T1, T2, T3 are identical with the construction shown in FIG. 9, and this portion is omitted. A pair of lamps L1, L2, lamps L3, L4, lamps L5, L6, lamps L7, L8, lamps L9, L10, lamps 11, 12 are respectively connected to the high tension output terminals at the secondary side of the output transformers T1, T2, T3 as shown in the drawing. The high tension terminals at the secondary side of the output transformers connected to the one side a and the other side b of each pair of lamps are in counter phase mutually. Namely, the output terminals A and L are mutually in counter phase, and similarly, D and E, H and I, M and X, P and Q, and T and U are mutually in counter phase.

The terminals N and C, R and G, V and K which are mutually in counter phase at the one side of the secondary coils S1 and S4 of each output transformer T1, T2, T3 are connected by means of the resistors RS1, RS4 as shown in FIG. 11. The terminals B and 0, F and S, J and W are connected by means of the resistors RS2, RS3 which are in counter phase relation by means of the resistors RS2, RS3. Each output terminal of all the secondary coils S1, S2, S3 S4 in total of twelve pieces is connected in series mutually on one pieces of a loop circuit forming the closed loop. This loop circuit is formed by one piece of the closed loop circuit electric current carrying route that starts from terminal H based on the terminal H of one side of the secondary coil S4 of the output transformer T2, through the coils S1, S4 of the output transformer T3, coils S2, S3 of the output transformer T2, coils S1, S4 of the output transformer T2, coils S1, S4 of the output transformer T1, coils S2, S3 of the output transformer T3, and lamps 12, 11, and coils S1, S4 of the output transformer T2, and come back to the terminal H. For reference, N in the drawing denotes a connector.

Figure 12:
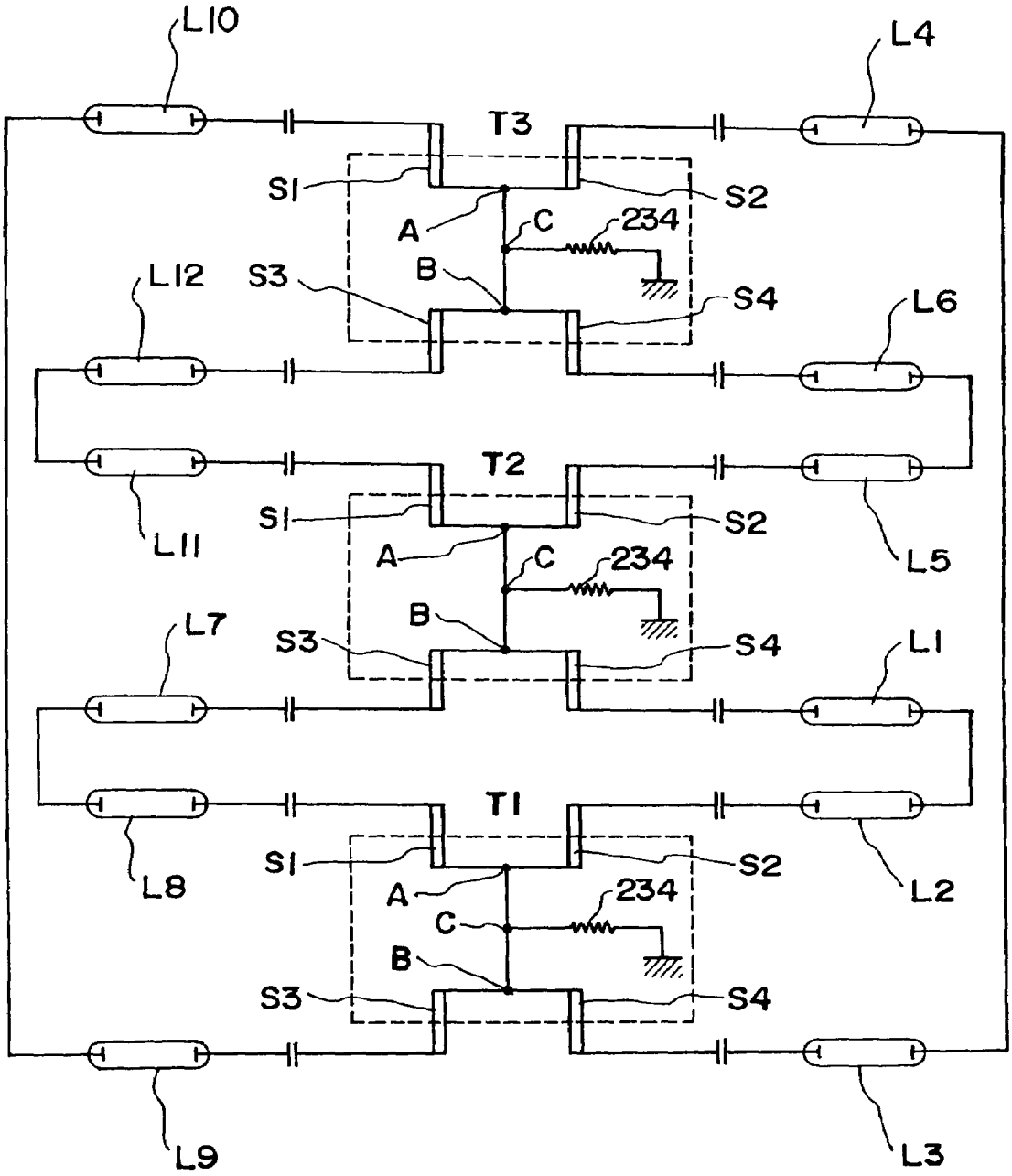
FIG. 12 denotes a circuit diagram showing another embodiment of the present invention.

Next, an improved embodiment of the embodiment shown in FIG. 1 is explained by referring to FIG. 12. The output transformer used in the lamp drive circuit generates a normally magnetic line of forces 226, 228, as shown in FIG. 10A, on one core portion 222*a* of the upper core 222 and the other core portion 222*b*. When an unbalance occurs in the electric current of the secondary coils S1, S2 of the core portion 222*a* and the secondary coils S3, S4 of the core portion 222*b*, a coupling capacitor X generates between the core portion 222*a* and the core portions 222*b* and the magnetic line of force 230 generates on the lower core portion 224. The electric current flows between the core portions 222*a* and 222*b* by the magnetic line of force 230 and the electric current totally becomes invalid electric current, causing an unbalance in the electric current flowing in the secondary coils S1 and S2 of the core portion 222*a* and the secondary coils S3 and S4 of the core portion 222*b*. The present invention dissolves this phenomenon by connecting (short-circuiting) the terminals NB, OC, RF, SG, VJ, WK at one side of the identical phase of the secondary coils S1 and S2 of each output transformer T1, T2, T3 as shown in FIG. 12, and the series connection (short-circuiting) of each middle point AB of the short-circuiting line is effected by the line 232, and the mid point of the line 232 is connected to the ground through a high resistor 234 of 1 ohm.

As described in the foregoing, when a point A and a point B are connected in series with a line 232, the electric current flows between A and B, and the coils S1, S2 of the secondary coils and the secondary coils S3, S4 of each output transformer T1,T2, T3 becomes an equal voltage (potential). Each output terminal of all the secondary coils S1–S4 of total of twelve pieces at the secondary side of the output transformers T1, T2, T3 is connected in series mutually on one piece of the loop circuit forming the closed loop. Twelve pieces of the lamps L1–L12 are connected in series to the loop circuit, and the electric current flows to the twelve pieces of the lamps through the line 232 connecting A and B. When the electric current flows to all of the lamps, the secondary coils S1 and S2 or S3 and S4 of each output transformer becomes the identical potential by the operation of the shunt chalk shunt transformer) and also, as the A and B points are connected, the secondary coils 511, S2 and the secondary coils S3, S4 become the voltage in the neighborhood value. When the A and B points are connected and are connected to the ground through the high resistor line 234, the voltage corresponding to the electric current flowing in the ground through the high resistor 234 generates at the point C. Theoretically, the C point is at zero volts, but the C point maintains the potential offset from the zero point by the unbalance between the secondary coils S11, S2 and the secondary coils S3, S4 due to the floating capacity of the output transformer or the leakage nductor and the like. It may be suggested to determine the value of the resistor 234 so that this potential becomes a safe voltage, but there is potential that the C point fluctuates by the condition of an external temperature and the like so that in this embodiment, for the time being, it is set at 1 ohm. However, this resistance value is not a limiting value, and may be chosen from a proper value among values higher than the whole impedance.

Furthermore, in the execution of the embodiment of the present invention, it is not an indispensable condition to ground the line 234 by means of the high resistor 234. When the unbalance between the secondary coils S1, S2 and the secondary coils S3, S4 becomes large, the unbalance electric current flowing through the high resistor 234 increases. This electric current becomes totally invalid electric current which becomes a cause of deterioration of efficiency, but in this embodiment, the unbalance condition generated between the secondary oils S1–S4 on account of the serial connection of the A and B points changes by the flow of the electric current corresponding to the unbalance between the coils which results in the amendment of the unbalance, changing the potential at the C point becomes zero, and the luminance of each lamp L1–L12 becomes a constant. Furthermore, the leakage of the capacitive charge at the core portions 222*a* and 222*b* or the reduction of the magnetic flux 230 crossing between the core portions 222*a* and 222*b* occurs. The other constructions of the present embodiment illustrated in FIT. 12 are identical with the embodiment illustrated in FIG. 11.

Figure 13:
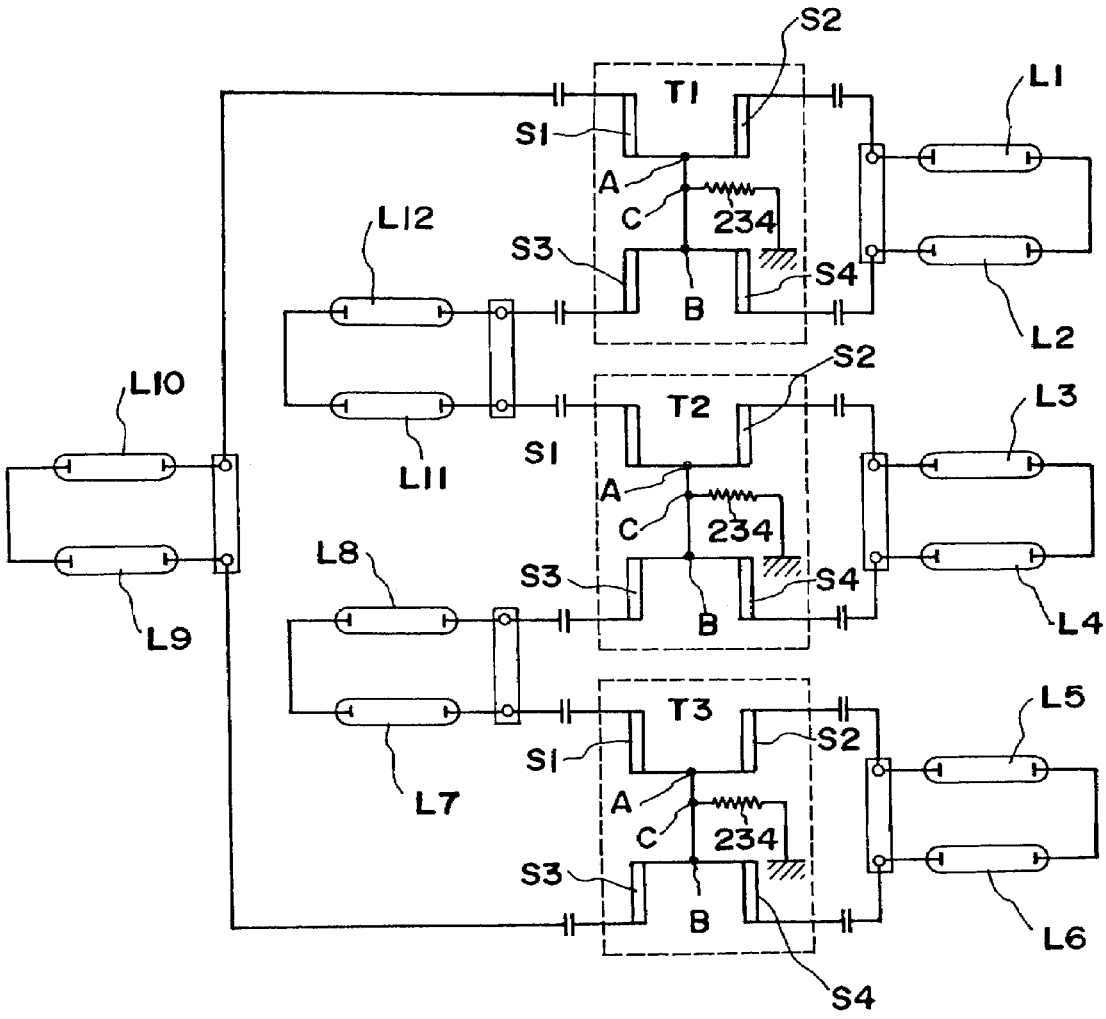
FIG. 13 denotes a circuit diagram showing another embodiment of the present invention.

FIG. 13 shows an embodiment wherein each output terminal of the whole secondary coils S1–S4 in the total of twelve pieces at the secondary side of the output transformers T1, T2, T3 is connected in series mutually on the loop circuit forming the closed loop. One and the other of each pair of lamps are connected to output terminals of the secondary coils in counter phase relation respectively. The construction of a connecting circuit of short-circuiting the A and B points at the secondary side of each trans-former is identical with the construction shown in FIG. 12, but may be regarded the same with the construction shown in FIG. 11.

Figure 14:
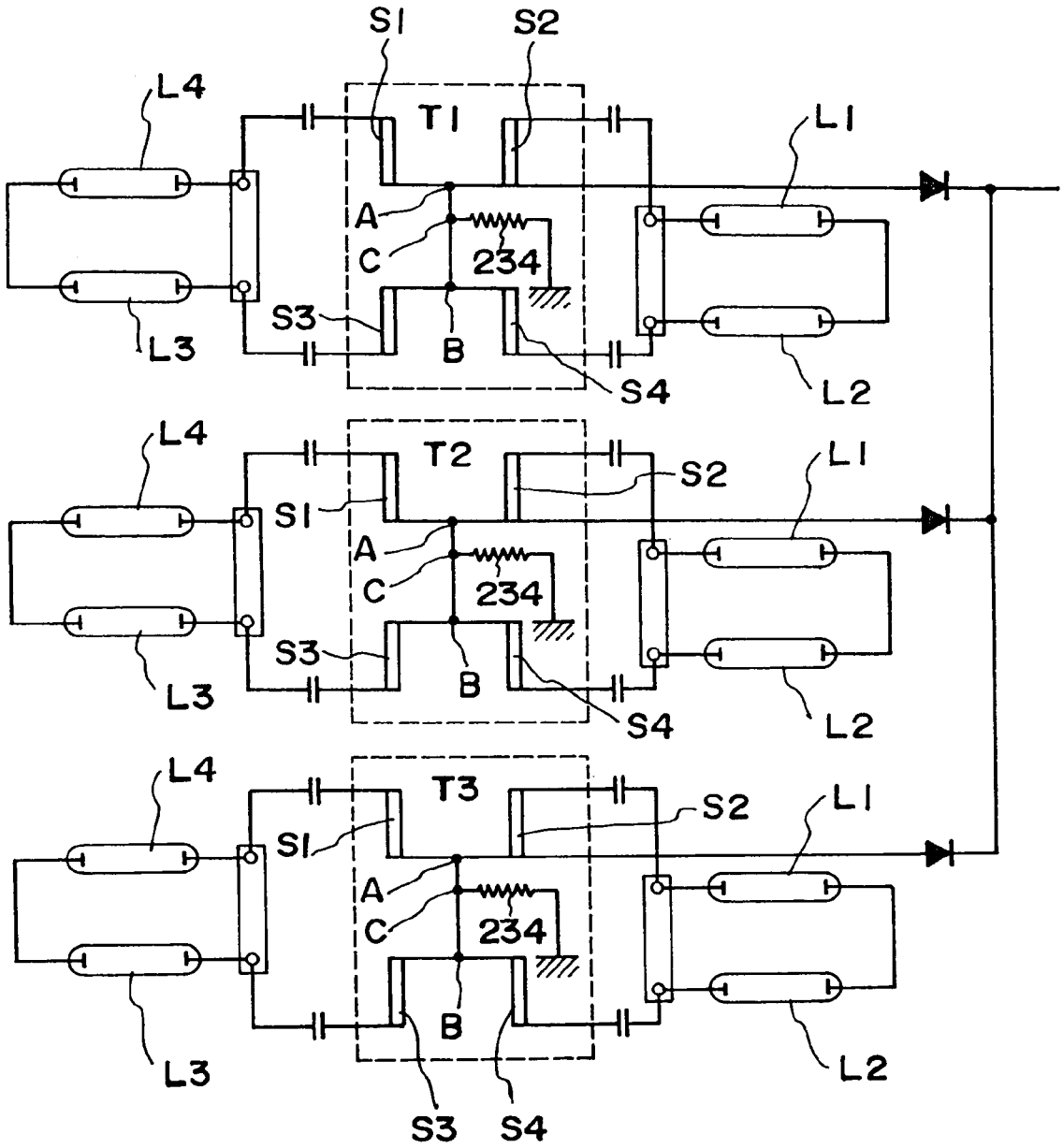
FIG. 14 denotes a circuit diagram showing another embodiment of the present invention.
Figure 15:
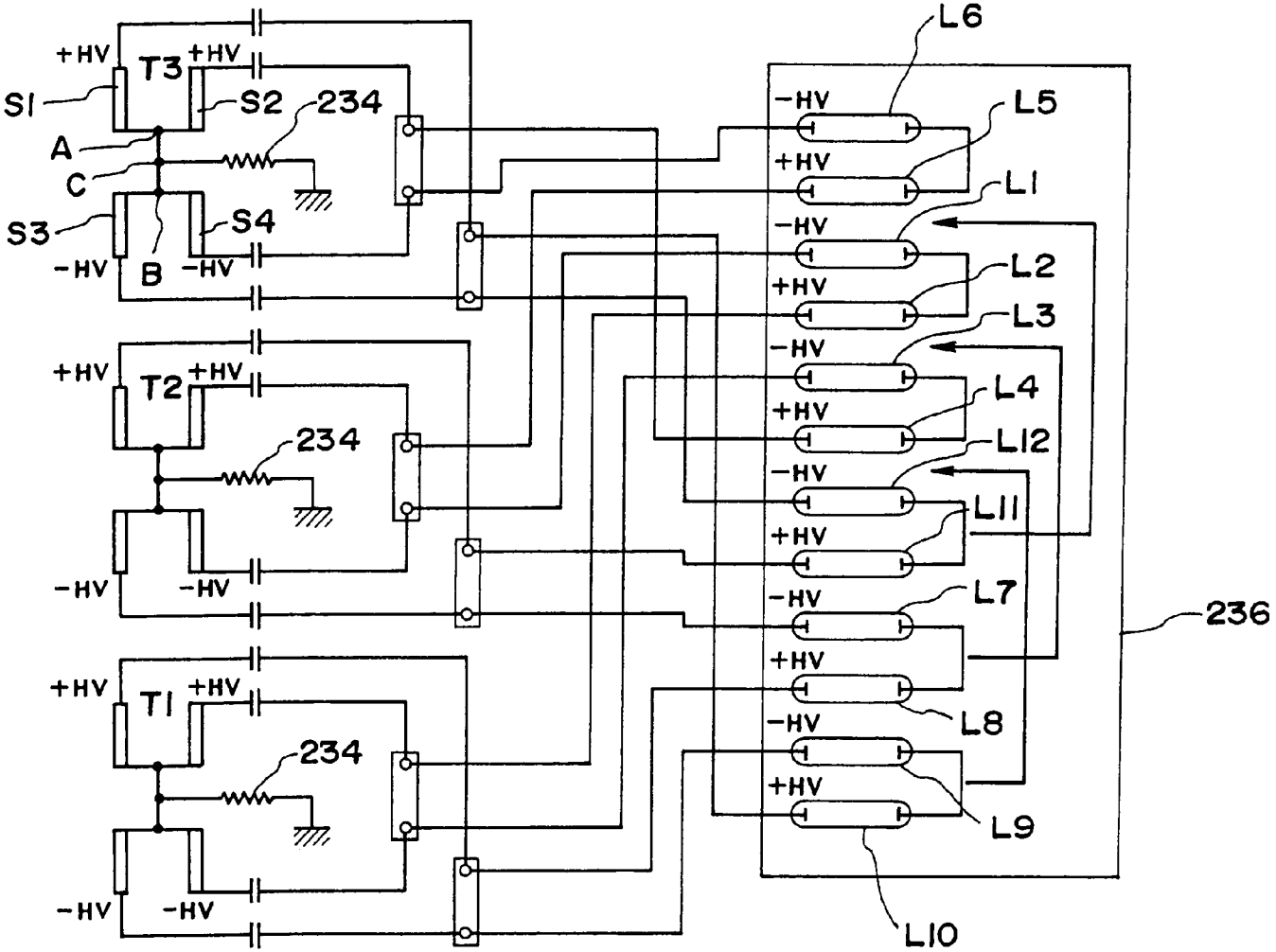
FIG. 15 denotes a circuit diagram showing another embodiment of the present invention.

FIG. 14 shows a construction wherein a closed loop electric current carrying route is formed for each transformer T1–T3, and four pieces of lamps L1–L4 are connected in series to each electric current carrying route. FIG. 15 shows an example of a preferred arrangement of the lamps L1–L12 against a backlight unit substrate 236. Connecting terminals of a left end of the lamp on the substrate 236 are arranged to be in counter phase mutually.

In the drawing, −HV and +Hv shows secondary high tension output mutually in counter phase. For example, when the output −HV is impressed to the connecting terminals a, c, e, f, i, k of each lamp arranged, for example in this order, the output +HV is impressed to the connecting terminals b, d, e, h, 1. As described above, a feasibility of obtaining a preferred drive characteristic is experimentally confirmed with the foregoing construction. When the construction is of mutually counter phase relation of the connecting terminals of the left side of each lamp L1–K12, the present invention is not limited particulary to the arrangement of the lamps as shown in FIG. 15, and the position of the lamp may be changed to a position indicated by the arrow mark in the drawing, and other arrangement last item are connected with lead wires. This invention is not particularly limited to this construction, and one piece of U-shaped tube lamp may be used instead of a pair of lamps. Furthermore, each output transformer used in this invention is identical and the number of windings of each secondary coil is identical.

Figure 16:
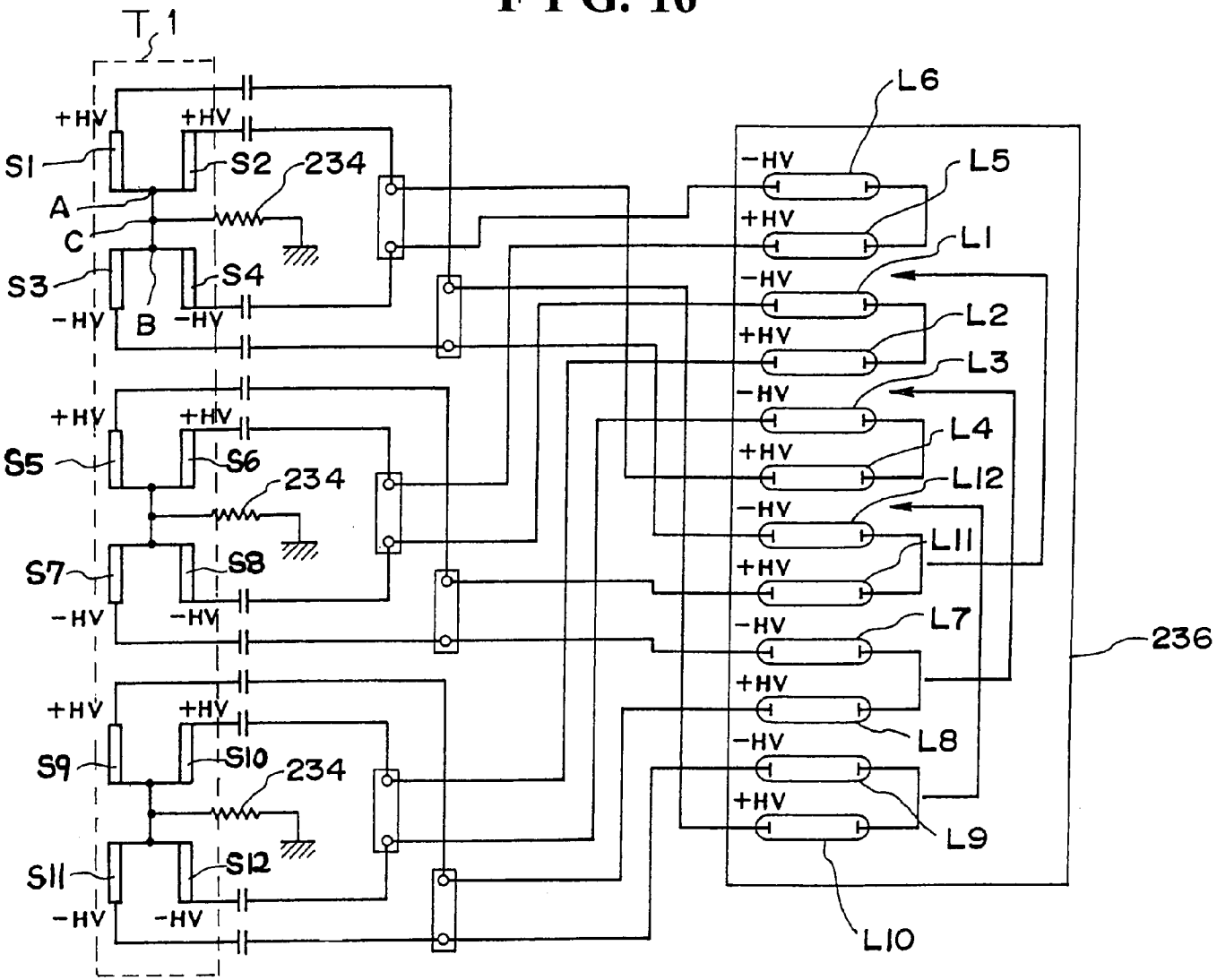
FIG. 16 denotes a circuit diagram showing another embodiment of the present invention.
Figure 17:
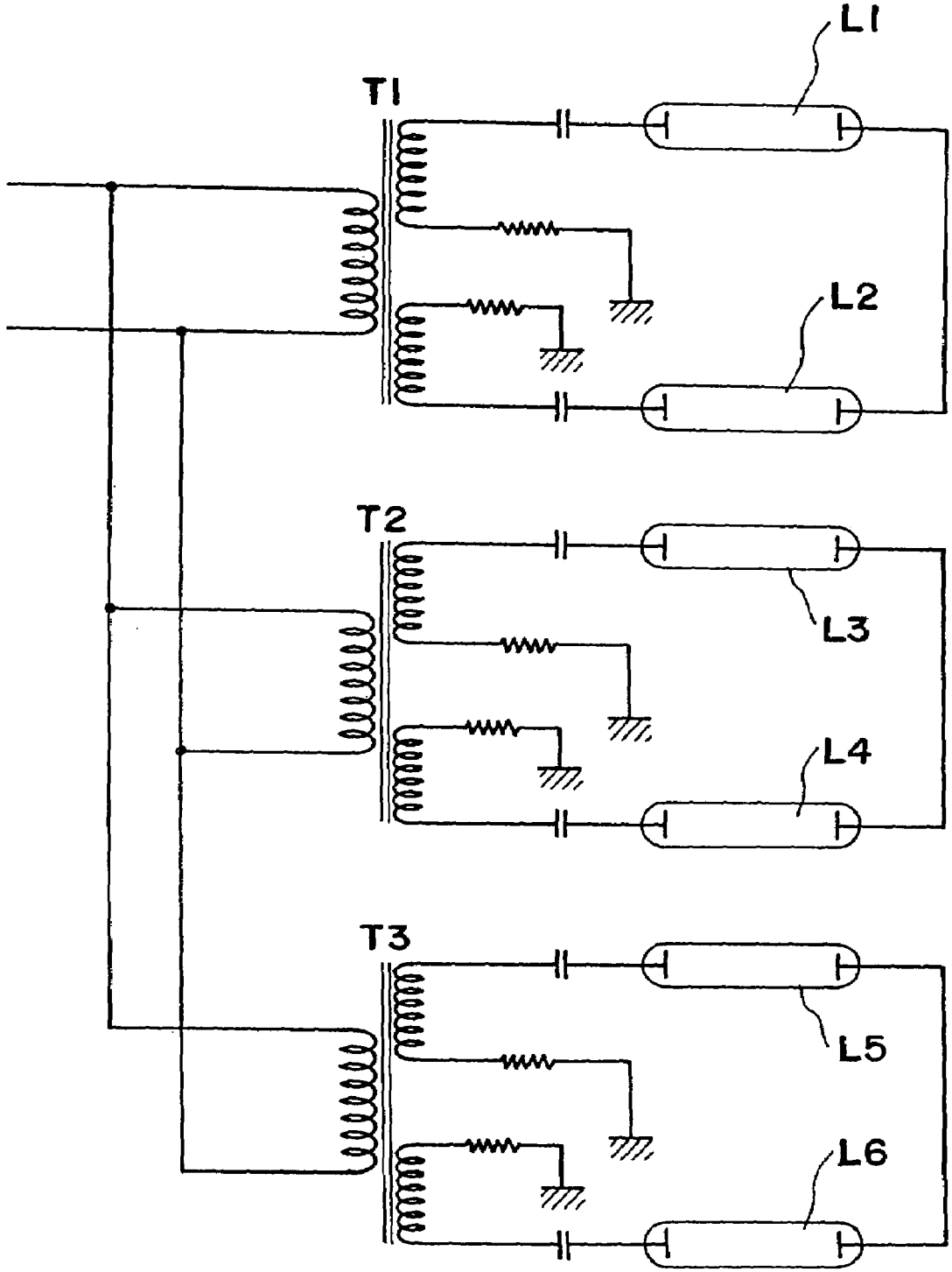
F I G. 17 PRIOR ART
FIG. 17 denotes a circuit diagram of conventional technologies.

Furthermore, the present invention has made it possible to light up a large number of the lamps L1–L12 uniformly by using a single output transformer TF 1 of 1 output-12 output type formed by winding the secondary windings S1–S12 on the identical core as shown in FIG. 16. The embodiment shown in FIG. 15 is identical with the embodiment shown in FIGS. 15 and 13 except for the contruction using one output transformer instead of three pieces of the transformers T1, T2, and T3.

What is claimed is:

1. An illumination unit drive circuit for driving a plurality of illumination units, the illumination unit drive circuit comprising:

a plurality of output transformers, wherein each of said output transformers is a 1 input-plural output type transformer, wherein each of said output transformers has a primary side and a secondary side, the primary side of each output transformer having one primary winding, and the secondary side of each output transformer having a plurality of secondary windings, wherein the primary sides of said plurality of output transformers are connected, wherein AC signals are inputted to the primary sides of said output transformers, wherein a high tension output is induced at the secondary side of each of said plurality of output transformers, wherein the plurality of illumination units are operated by the high tension output, wherein the plurality of illumination units comprises at least a first illumination unit and a second illumination unit, wherein each of the plurality of illumination units includes a first electrode and a second electrode, wherein the secondary side of each of said output transformers includes at least one high tension terminal, wherein the first electrode of the first illumination unit is connected to a first one of said high tension terminals, and the first electrode of the second illumination unit is connected to a second one of said high tension terminals, and wherein the first one of said high tension terminals and the second one of said high tension terminals are in a counter phase relation with one another.

2. An illumination unit drive circuit according to claim 1, wherein each of the output transformers is a 1 input-2 output type transformer, and wherein each of the illumination units is a cold cathode fluorescent lamp.

3. An illumination unit drive circuit according to claim 1, wherein said plurality of output transformers comprises a first 1 input-2 output type transformer and a second 1 input-2 output type transformer, wherein the secondary side of said first 1 input-2 output winding transformer includes the first one of said high tension terminals, and wherein the secondary side of said second 1 input-2 output type transformer includes the second one of said high tension terminals.

4. An illumination unit drive circuit according to claim 1, wherein said plurality of output transformers comprises a first 1 input-plural output type transformer and a second 1 input-plural output type transformer, wherein the secondary side of said first 1 input-plural output type transformer includes the first one of said high tension terminals and a third one of said high tension terminals, wherein the secondary side of said second 1 input-plural output type transformer includes the second one of said high tension terminals and a fourth one of said high tension terminals, wherein the first illumination unit and the second illumination unit are connected between the first one of said high tension terminals and the second one of said high tension terminals, wherein the plurality of illumination units further comprises a third illumination unit and a fourth illumination unit, wherein the secondary side of each of said first and second 1 input-plural output type transformers includes at least one ground terminal, wherein the third illumination unit is connected between the third one of the high tension terminals and the ground terminal of said first 1 input-plural output type transformer, and wherein the fourth illumination unit is connected between the fourth one of the high tension terminals and the ground terminal of said second 1 input-plural output type transformer.

5. An illumination unit drive circuit according to claim 1, wherein said plurality of output transformers comprises a first 1 input-multiple output type transformer and a second 1 input-multiple output type transformer, wherein the secondary side of said first 1 input-plural output type transformer includes the first one of said high tension terminals, a third one of said high tension terminals, a fifth one of said high tension terminals, and a seventh one of said high tension terminals, wherein the secondary side of said second 1 input-plural output type transformer includes the second one of said high tension terminals, a fourth one of said high tension terminals, a sixth one of said high tension terminals, and an eighth one of said high tension terminals, wherein the plurality of illumination units further comprises third to eighth illumination units, wherein the first and second illumination units are connected between the first one of said high tension terminals and the second one of said high tension terminals, wherein the third and fourth illumination units are connected between the third one of said high tension terminals and the fourth one of said high tension terminals, wherein the fifth and sixth illumination units are connected between the fifth one of said high tension terminals and the sixth one of said high tension terminals, wherein the seventh and eighth illumination units are connected between the seventh one of said high tension terminals and the eighth one of said high tension terminals, wherein the third one of said high tension terminals and the fourth one of said high tension terminals are in a counter phase relation with one another, wherein the fifth one of said high tension terminals and the sixth one of said high tension terminals are in a counter phase relation with one another, wherein the seventh one of said high tension terminals and the eighth one of said high tension terminals are in a counter phase relation with one another, wherein the secondary side of each of said first and second 1 input-plural output type transformer includes at least one secondary side low tension terminal, and wherein each of the secondary side low tension terminals are earthed.

6. An illumination unit drive circuit according to claim 1, wherein said plurality of output transformers comprises a first 1 input-multiple output type wound transformer, a second 1 input-multiple output type wound transformer, and a third 1 input-multiple output type wound transformer, wherein said high tension terminal of said first 1 input-multiple output wound type transformer is in a counter phase relation with said high tension terminal of one of said second and third 1 input-multiple output wound type transformers, wherein said high tension terminal of said first 1 input-multiple output wound type transformer and said high tension terminal of one of said second and third 1 input-multiple output wound type transformers are connected by one of the plurality of illumination units or by serially connected ones of the plurality of illumination units, and wherein each of said high tension terminals of said first, second and third 1 input-multiple output wound type transformers are connected in a loop form.

7. An illumination unit drive circuit according to claim 1 wherein the secondary windings are formed with a plurality of wires arranged in parallel forms.

8. An illumination unit drive circuit according to claim 1, wherein each of said plurality of output transformers is a wound type transformer, and wherein, for each of said plurality of output transformers, a first secondary winding is wound on a bobbin, and a second secondary winding having an identical number of windings as said first secondary winding is wound on said first secondary winding by means of an insulator.

9. An illumination unit drive circuit for driving a plurality of illumination units the illumination unit drive circuit comprising:

a plurality of output transformers, wherein each of said output transformers is a 1 input-plural output type transformer, wherein each of said output transformers has a primary side and a secondary side, the primary side of each output transformer having one primary winding, and the secondary side of each output transformer having a plurality of secondary windings, wherein the primary sides of said plurality of output transformers are connected, wherein the plurality of illumination units are illuminated by a high tension output induced at the secondary side of each of said plurality of output transformers, wherein a loop circuit is formed by connecting all of the secondary windings of said output transformers in series in a closed loop state type, and wherein one or more of the illumination units are connected between respective pairs of the secondary windings of said plurality of output transformers.

10. An illumination unit drive circuit according to claim 9, further comprising a circuit for detecting an abnormal voltage, wherein said circuit for detecting an abnormal voltage is connected to a connecting point of a first secondary output terminal of said plurality of output transformers, and wherein the first secondary output terminal of said plurality of output transformers is in counter phase with a second secondary output terminal of said plurality of output transformers.

11. An illumination unit drive circuit according to claim 9, further comprising a voltage clamp circuit, wherein said voltage clamp circuit is connected to a connecting point of a first secondary output terminal of said plurality of output transformers and a second secondary output terminal of said plurality of output transformers, and wherein said first secondary output terminal and said second secondary output terminal are in a counter phase relation.

12. An illumination unit drive circuit according to claim 9, wherein one side of a plurality of each of said secondary windings of said plurality of output transformers are mutually short-circuited.

13. An illumination unit drive circuit according to claim 12, further comprising a wire disposed so as to short-circuit one side of each of said secondary windings, wherein said wire is connected to earth by means of a high resistor element.

14. An illumination unit drive circuit according to claim 9, wherein each of said plurality of output transformers comprises four secondary windings on an identical core, wherein one side of the four secondary windings are all short-circuited, and wherein a short-circuiting line is connected to earth by means of a high resistor element.

15. An illumination unit drive circuit according to claim 1, wherein the plurality of illumination units are arranged in parallel on a substrate, and wherein adjacent terminals of the plurality of illumination units are in a counter phase relation.

16. An illumination unit drive circuit for driving a plurality of illumination units, the illumination unit drive circuit comprising:

a plurality of output transformers, wherein each of said output transformers is a 1 input-multiple output type transformer, wherein each of said output transformers has a primary side and a secondary side, the primary side of each output transformer having one primary winding, and the secondary side of each output transformer having a plurality of secondary windings, wherein the primary sides of said plurality of output transformers are connected, wherein the plurality of illumination units are illuminated by a high tension output induced at the secondary side of each of said plurality of output transformers, wherein a plurality of the secondary windings of said output transformers are connected in series in a closed loop form so as to provide a loop circuit so that secondary output terminals of said output transformers in a counter phase relation are connected, and wherein the plurality of illumination units are connected to the loop circuit so that a voltage of a counter phase is impressed to electrodes of both terminals of the plurality of illumination units.

17. An illumination unit drive circuit for driving a plurality of illumination units, the illumination drive circuit comprising:

a single output transformer, wherein said single output transformer is a 1 input-plural output type transformer, wherein said single output transformer has a primary side and a secondary side, the primary side of said single output transformer having one primary winding, and the secondary side of said single output transformer having a plurality of secondary windings, wherein the plurality of illumination units are connected to the secondary side of said single output transformer, wherein the plurality of illumination units are illuminated by a high tension output induced at the secondary side of said single output transformer, wherein all or a plurality of secondary outputs of said single output transformer are connected in series in a closed loop form so as to form a loop circuit so that the secondary output terminals which are in a counter phase relation are connected, and wherein a plurality of the illumination units are connected to the loop circuit so that a voltage of a counter phase is impressed to electrodes of both terminals of the plurality of illumination units.

18. An illumination unit drive circuit according to claim 17, wherein the plurality of illumination units are disposed on a substrate in parallel and side by side, and wherein adjacent terminals of the plurality of illumination units are in a counter phase relation.

19. An illumination unit drive circuit according to claim 9, wherein the plurality of illumination units are arranged in parallel on the substrate, and wherein adjacent terminals of the plurality of illumination units are in a counter phase relation.

* * * * *